US005244334A

United States Patent [19]

Akita et al.

[11] Patent Number: 5,244,334

[45] Date of Patent: Sep. 14, 1993

[54] APPARATUS FOR INSTALLING AND WITHDRAWING ROAD SIGN

[75] Inventors: Satoshi Akita; Toshiya Yonemori; Masanori Sugii, all of Toyota, Japan

[73] Assignee: Shinmei Industry Co., Ltd., Toyota, Japan

[21] Appl. No.: 817,692

[22] Filed: Jan. 7, 1992

[30] Foreign Application Priority Data

Jan. 17, 1991 [JP] Japan ..... 3-018329
Sep. 7, 1991 [JP] Japan ..... 3-255722

[51] Int. Cl.[5] ..... B65G 67/02

[52] U.S. Cl. ..... 414/502; 221/185; 404/6; 414/917; 414/501; 414/503; 414/528; 414/555; 414/797.8; 414/795.3; 414/791.5; 198/373

[58] Field of Search ..... 414/789.9, 795.3, 917, 414/501, 502, 503, 434, 436, 437, 438, 797.8, 439, 442, 528, 551, 553, 555, 543, 789.7, 791.5, 798.1; 221/185, 197; 198/373, 406; 404/6, 9

[56] References Cited

U.S. PATENT DOCUMENTS 3,750,900 8/1973 Piercey ..... 414/503 X
4,747,515 5/1988 Kasher ..... 221/185 X
4,936,485 6/1990 Downing ..... 221/185 X
5,054,648 10/1991 Luoma ..... 404/6 X

FOREIGN PATENT DOCUMENTS 0145625 6/1985 European Pat. Off. .
0421198 4/1991 European Pat. Off. .
2747183 4/1978 Fed. Rep. of Germany .
210147 9/1987 Japan ..... 414/555
63-241208 10/1988 Japan .
2175336 11/1986 United Kingdom .

*Primary Examiner*—Frank E. Werner
*Attorney, Agent, or Firm*—Wenderoth Lind & Ponack

[57] ABSTRACT

An apparatus for installing and retrieving road signs has a conveyor for conveying a group of road signs, a pair of group of signs-conveying members for conveying the group of road signs while supporting both sides of a bottom portion of the group of road signs, a driving device for changing over the road sign to a support-releasing condition, a pair of sign-receiving elements arranged at sign-separating positions, a moving device for causing the pair of sign-receiving elements to approach and separate, a sign-ascending and descending device for supporting and causing the road sign to ascend and descend, a device for correcting the posture of the road sign, a sign-holding device for releasably holding the road sign, a position-changing device for shifting the sign-holding device from a position where the sign is separated to a position where the sign is installed and retrieved, and a holding device-ascending and descending mechanism for causing the sign-holding device to ascend and descend at the position where the sign is installed and retrieved. These are carried on a loading platform of a travelling vehicle body.

2 Claims, 40 Drawing Sheets

APPARATUS FOR INSTALLING AND WITHDRAWING ROAD SIGN

BACKGROUND OF THE INVENTION

1. Field of the Invention

The present invention relates to an apparatus for installing and retrieving hollow road signs installed on, for example, boundaries between road repairing sites and roadways.

2. Description of the Prior Art

Aiming at an improvement of safety, labor-saving and an improvement of working efficiency, an apparatus for automatically installing the above-described road signs on road surfaces has been proposed (for example Japanese Patent Application Laid-Open No. Sho 63-241208).

This apparatus for installing signs comprises conveyors provided swingably up and down and tiltedly on the side portions of a travelling vehicle body for conveying road signs, and wheels, which are trailedly rotated interlocking with a travelling of said travelling car body, provided on free end portions of conveyor frames, a rotating force of said wheels being transmitted to driving shafts of said conveyors through reduction gears to drive the conveyors at a speed proportional to a travelling speed of the travelling vehicle body, and said road signs carried on the conveyors being dropped one by one on said road surfaces at desired intervals with said travelling of the travelling vehicle body.

However, an inclinedly descending inertia force acts upon the road signs conveyed by means of the conveyors, so that disadvantages have occurred in that they are apt to fall forward when engaged with the road surfaces at one side end of a bottom portion thereof and they are apt to irregularly tumble in a standing posture, thereby shifting in position, when contacting the road surfaces at a corner portion of said bottom portion thereof.

In addition, the above described apparatus has aimed at merely the installation of the signs and thus they have been manually retrieved as before. That is to say, said improvement of safety and said labor-saving have not been sufficiently achieved and also said improvement of working efficiency has not been sufficiently achieved.

Furthermore, a disadvantage has occurred also in that when positions of the signs to be installed are changed on any one of the right side and the left side of the travelling vehicle body, positions of the apparatus for installing the signs to be mounted on brackets on both sides of a loading platform must be changed and thus not only hard labor is required and a danger is apt to occur but also plenty of time is taken.

SUMMARY OF THE INVENTION

The present invention has been achieved in view of the above-described actual circumstances and it is a first object of the present invention to provide an apparatus capable of installing road signs in good order at appointed positions and automatically retrieving the installed road signs. It is a second object of the present invention to provide an apparatus capable of safely and simply changing positions of the road signs to be installed and retrieved in an optional direction of right and left directions of a travelling vehicle, e.g. a car, body in addition to an achievement of said first object.

An apparatus for installing and retrieving road signs according to a first invention achieving the above-described first object comprises means for conveying a group of a plurality of hollow road signs stacked upon one another, a pair of group of signs-conveying members for conveying said group of road signs while supporting both sides of a bottom portion of the group of the road signs, condition-changing over means for causing said pair of group of road signs-conveying members to approach and separate from each other to change between a sign-supporting condition and a support-releasing condition, a pair of sign-receiving means arranged at sign-separating positions at ends of the group of signs-conveying members, moving means for said pair of sign-receiving means to approach and separate from each other in a direction the same as a moving direction of the group of signs-conveying members, sign-ascending and descending means disposed within a hollow inside of the road sign for supporting and causing the ascending and descending of a road sign, posture-correcting means for correcting a posture of the road sign supported by means of said sign-ascending and descending means, sign-holding means for releasably holding the road sign, revolving means for revolving said sign-holding means ranging from a position, where the sign is separated, midway of a width of the car body to a position, where the sign is installed and retrieved, on one longitudinal side of the car body and a holding means-ascending and descending mechanism for causing ascending and descending of the sign-holding means at said position where the sign is installed and retrieved, carried on a loading platform of said travelling car body, respectively.

The apparatus for installing and retrieving road signs according to said second invention comprises position-changing means for changing the position, where the sign is installed and retrieved by means of the sign-holding means, onto the other longitudinal side of the car body, in addition to the above described characteristic construction of the first invention.

An installation of the road signs by means of said apparatus according to the first and second inventions is carried out by forward travelling of the travelling car body in the That is to say, the group of a plurality of road signs put one upon another is conveyed to a position where the lowermost road sign of the group of road signs is separated by a separating and approaching movement of the group of signs-conveying members and the sign-receiving means at the position where the sign is separated to take out the road sign on the sign-ascending and descending means.

The road sign separated on the sign-ascending and descending means is supported by means of the sign-holding means to be conveyed to the position where the sign is installed and retrieved and the sign-ascending and descending means is caused to descend to release the road sign held by the sign-holding means, thereby installing the road sign on a road surface.

A retrieval of the road sign is carried out by a rearward travelling of the travelling car body in the following manner. That is to say, the road sign installed on said road surface is supported by means of the sign-holding means and the sign-holding means is lifted up to convey the road sign to the position where the sign is separated, where the holding of the road sign by means of the sign-holding means is released to put the road sign in the sign-ascending and descending means.

Here, the direction of the road sign is corrected by means of said posture-correcting means and then the sign-ascending and descending means is caused to ascend and the sign-receiving means is positioned on the side of said bottom portion of the road sign to retrieve a road sign. The group of road signs is conveyed to the conveying means every time the above-described retrieval of the road sign is repeated, thereby to retrieve an appointed number of road signs.

With the apparatus according to the second invention, additionally the road signs can be installed and retrieved in an optional one of right and left sides of the travelling car body by changing the position where the road sign is installed and retrieved by means of the sign-holding means, on either one longitudinal side or the other longitudinal side of the car body.

BRIEF DESCRIPTION OF THE DRAWINGS

The first invention is shown in FIGS. 1 to 20, in which.

A preferred embodiment of the second invention is shown in FIGS. 21 to 41, in which.

DESCRIPTION OF THE PREFERRED EMBODIMENTS

Figure 1:
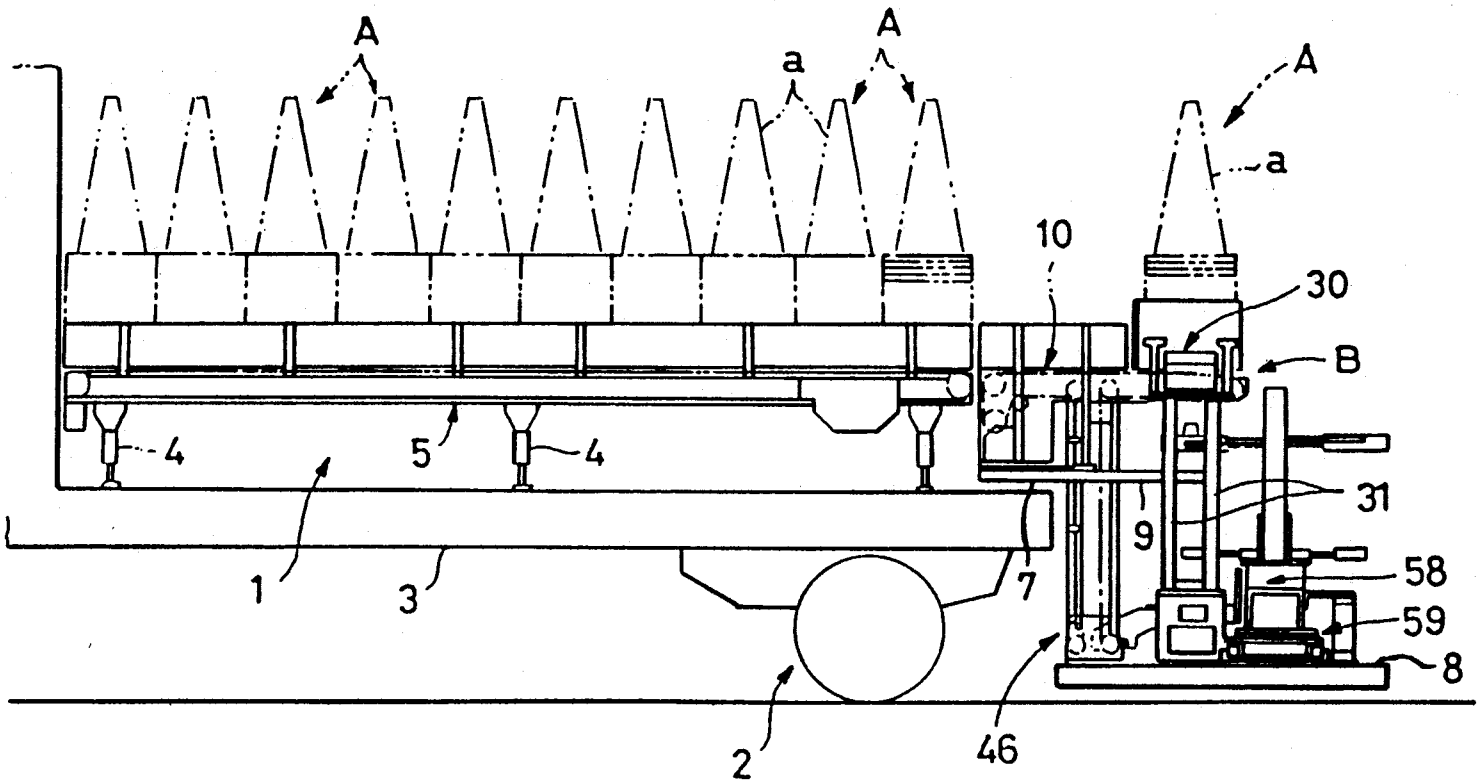
FIG. 1 is a side view showing an apparatus for installing and retrieving road signs.
Figure 2:
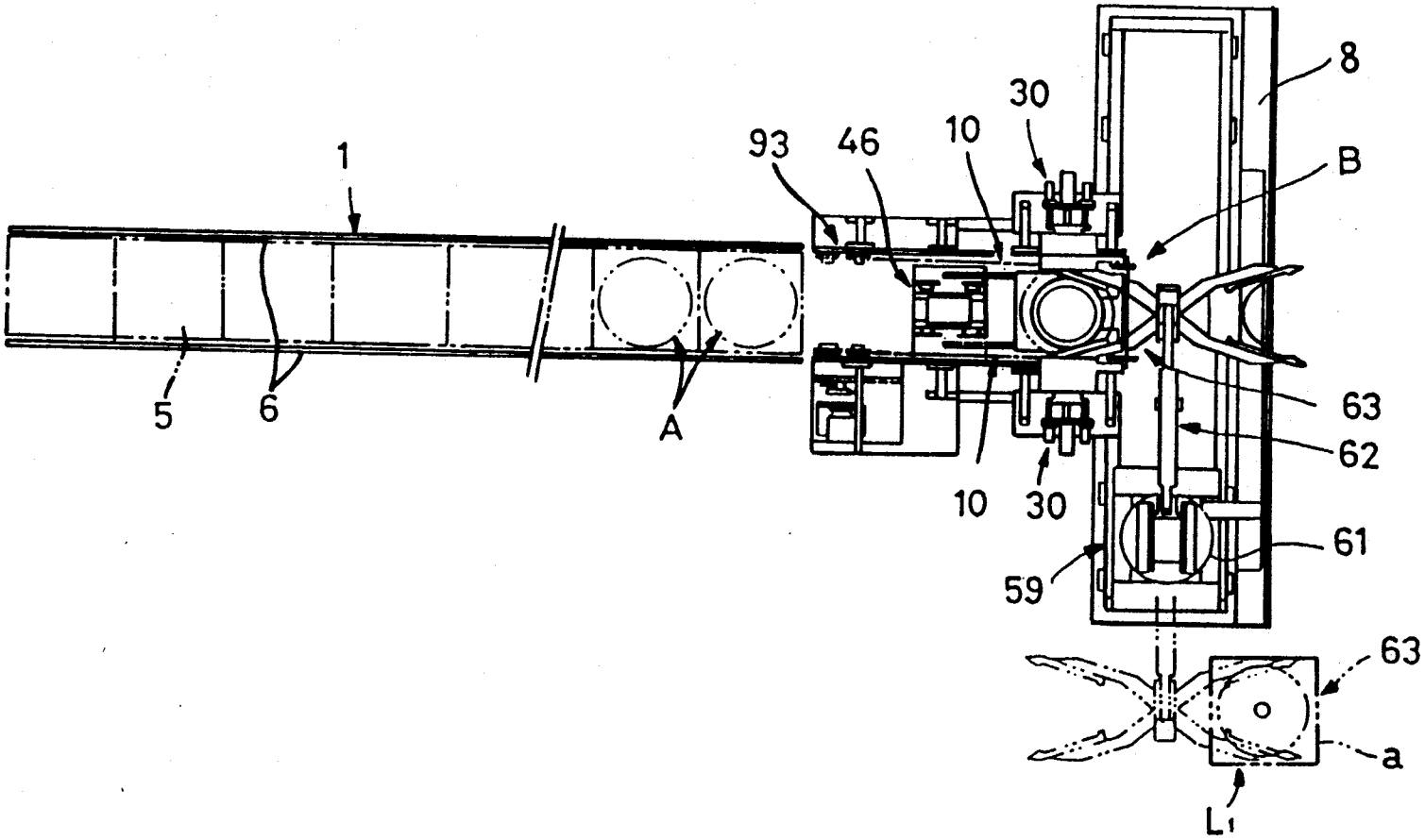
FIG. 2 is a plan view showing said apparatus for installing and retrieving road signs.
Figure 3:
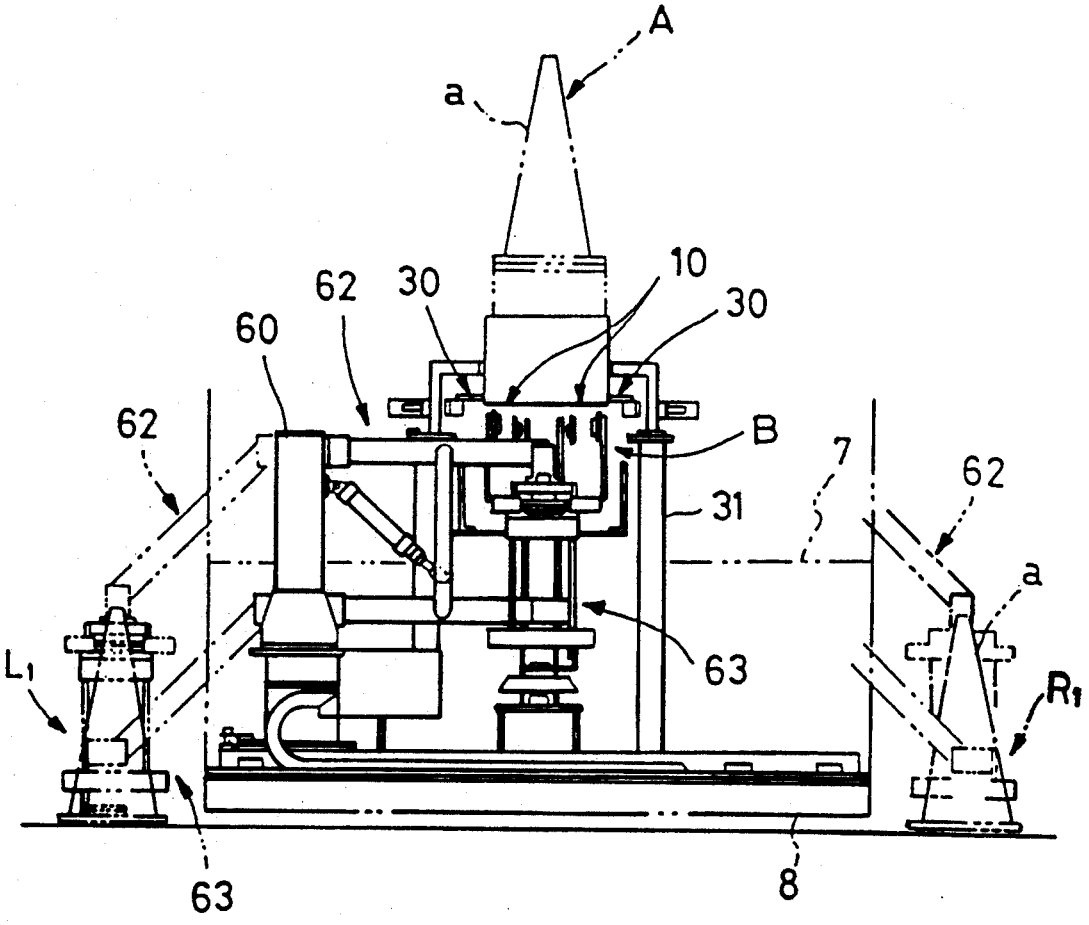
FIG. 3 is a rear view showing the apparatus for installing and retrieving road signs.
Figure 4:
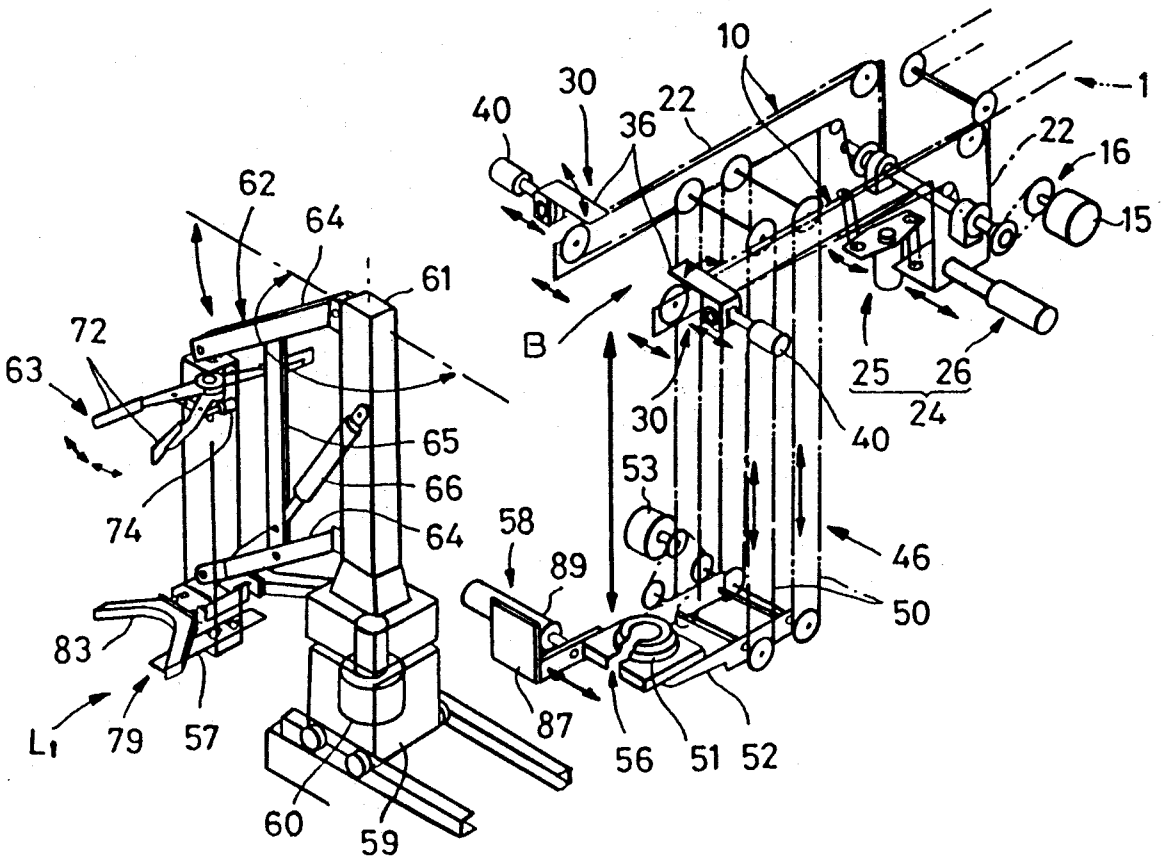
FIG. 4 is a diagram showing an operation of installing and retrieving road signs.

The preferred embodiments of the present invention will be described with reference to the drawings. FIGS. 1 to 3 show an apparatus for installing and retrieving road signs and FIG. 4 shows an operation of main parts. Referring to FIGS. 1 to 4, reference numeral 1 designates conveying means for conveying a group (A) of a plurality of road signs (a) put one upon another, jack-type supports 4 standing on a loading platform 3 of a travelling vehicle, such as a car, body 2 at an appointed interval for regulating a height, a conveyor 5 being provided extending over upper ends of said supports 4 for conveying said group (A) of road signs in the travelling direction of said travelling car body 2, and tumbling-preventing members 6 being arranged on both sides of said conveyor 5 for preventing the group (A) of road signs from tumbling.

The road signs (a) are composed of a hollow cone portion with a diverging skirt and a flange-like square base projected outward from said skirt of said cone portion and made of a synthetic resin material.

Reference numeral 7 designates a first base arranged on the rear portion side of said loading platform, reference numeral 8 designating a second base projected from a rear lower portion of the loading platform 3 through a stay 9 connected with said first base 7, and reference numeral 10 designating a pair of group of signs-conveying members installed on the first base 7 so as to be connected with said conveying means 1 for supporting both ends of a bottom portion of the group (A) of road signs to convey them.

Figure 5:
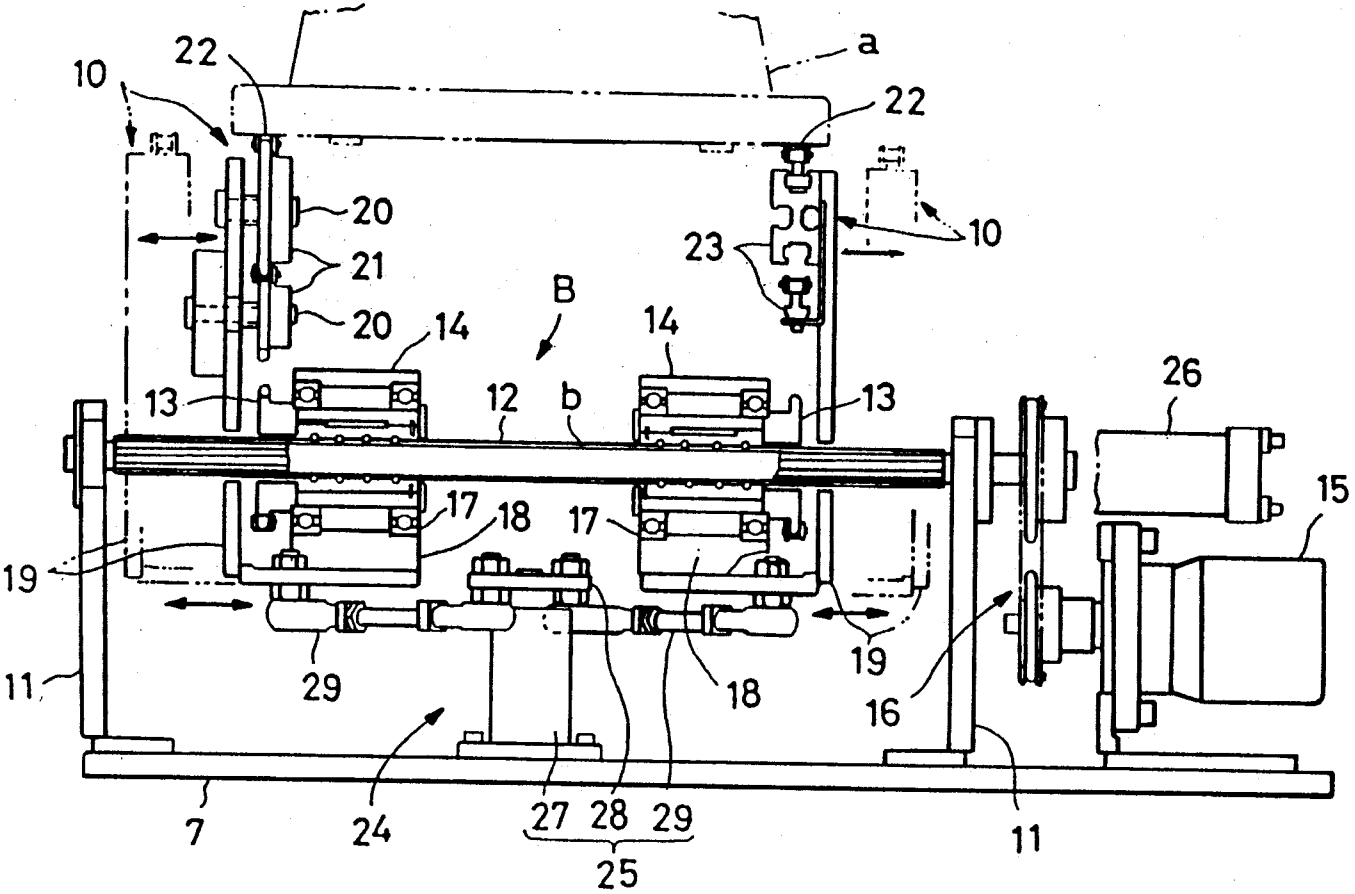
FIG. 5 is a diagram showing a form of a driving system for a group of signs-conveying member.
Figure 6:
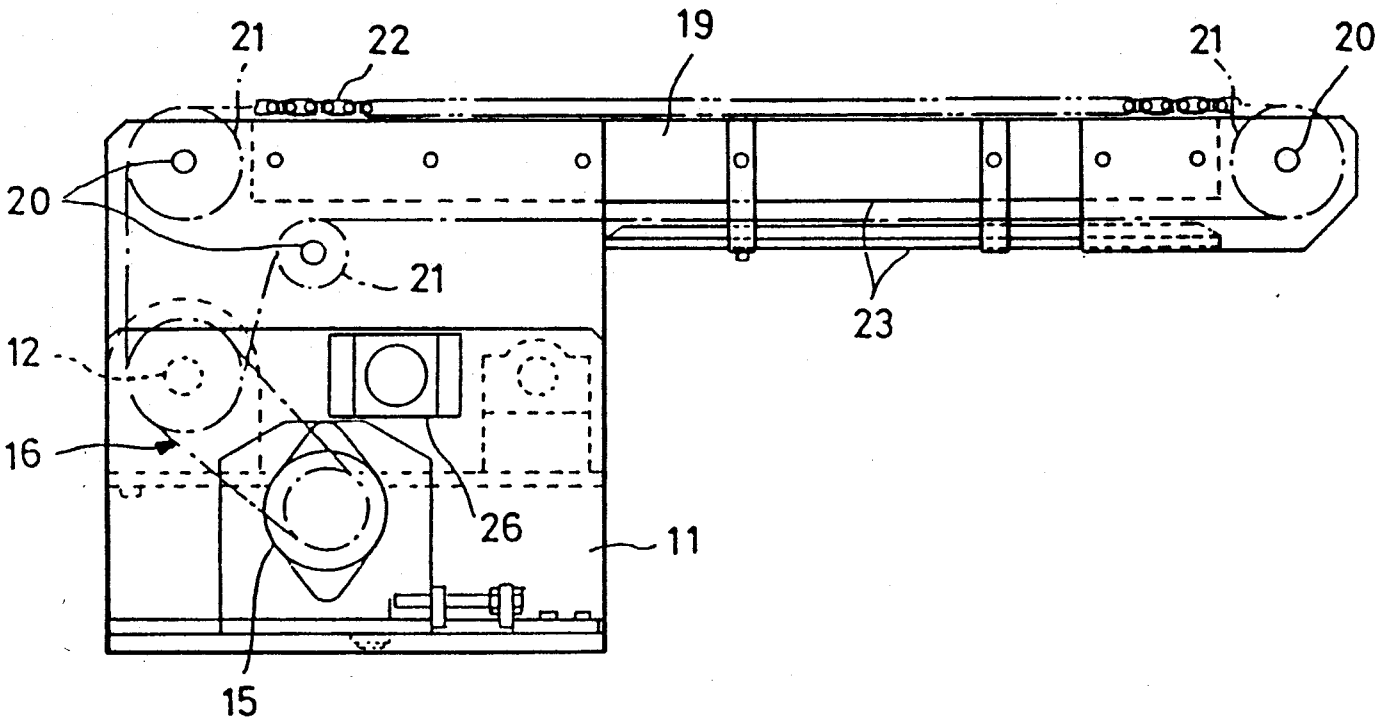
FIG. 6 is a side view showing said driving system for said group of signs-conveying member.

Speaking in more detail, as shown in FIGS. 5, 6, a pair of brackets 11 stand on the first base 7, a driving shaft 12 provided with a ball spline groove (b) being placed over said pair of brackets 11, and two female spline members 14 connected with a sprocket 13 on the driving side in an outer side portion thereof, respectively being engaged with said ball spline groove (b).

On the other hand, driving means 15, for example an oil-pressure pump, is carried on the first base 7 and a chain-type transmission mechanism 16 extends from said driving means 15 to said driving shaft 12.

A frame-fitting member 18 is supportedly mounted on said respective female spline members 14 through a ball bearing 17, a frame 19 being connected with said frame-fitting member 18 with its idle end side projected toward a rear portion of the loading platform 3, three sections trailing shaft 20 being installed on the idle end side and the base portion side of said frame 19 so as to be projected toward an inner surface, respectively, and a sprocket 21 on the trailing side being provided on a projecting end portion of the respective trailing shafts 20.

In addition, an endless chain 22 for conveying the group (A) of road signs is wound around said sprocket 13 on the driving side and said sprocket 21 on the trailing side, a guide member 23 supporting a straight run of said chain 22 being mounted on an inner side surface of the frame 19, and said group of signs-conveying members 10 supporting both sides of said bottom portion of the group (A) of road signs to convey them being adapted to be movable in a direction of the axis of the driving shaft 12.

Referring to FIG. 5, reference numeral 24 designates condition-changing over means for causing a pair of road signs-conveying members 10 to approach and separate from each other to change over to a sign-supporting condition and a supporting-releasing condition, said condition-changing over means 24 being composed of an interlocking mechanism 25 for causing the signs-conveying members 10 to approach and separate from each other and a driving mechanism 26 for shifting one group of signs-conveying member 10 in said direction of the axis of the driving shaft 12.

Figure 7:
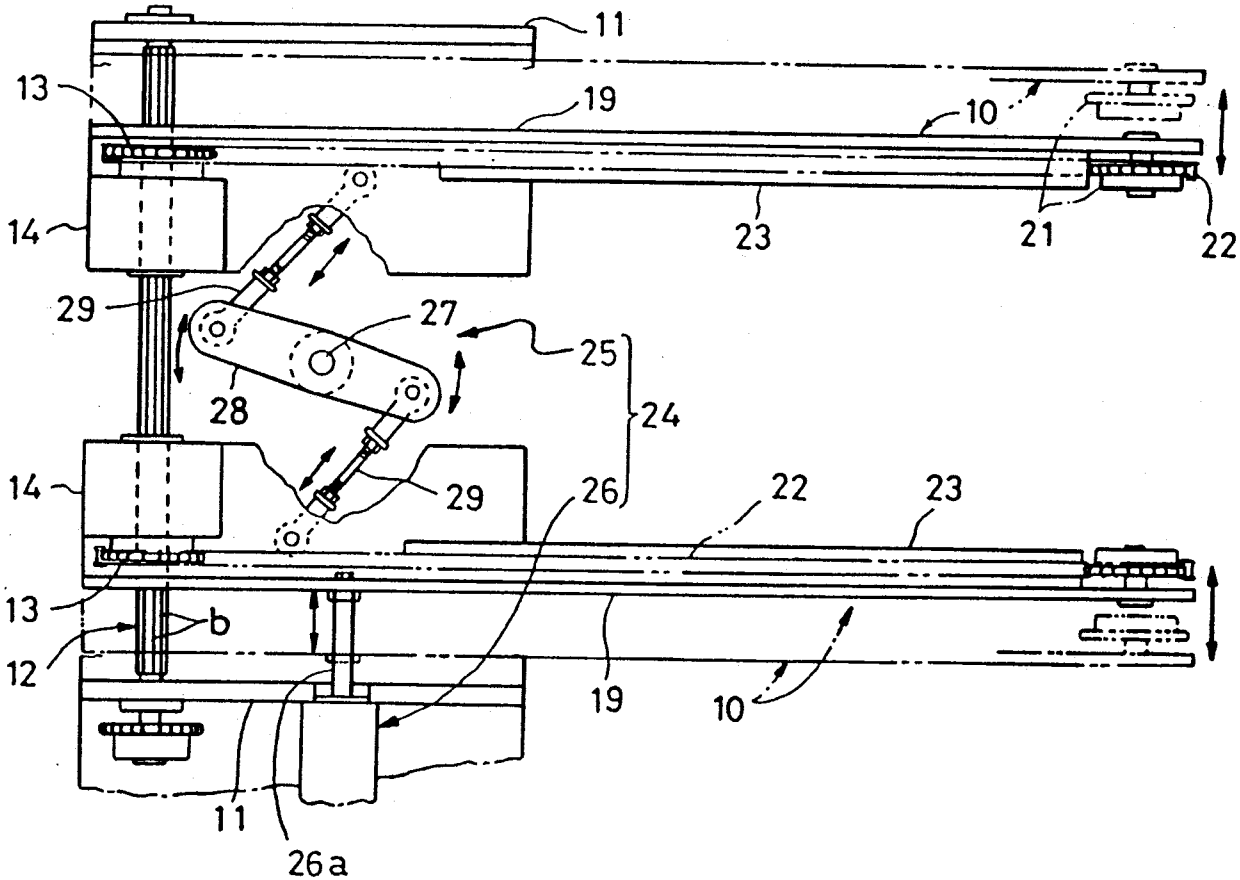
FIG. 7 is a plan view showing the group of signs-conveying member.

Said interlocking mechanism 25, as shown also in FIG. 7, comprises a supporting shaft 27 standing midway of a pair of the group of signs-conveying members 10 on the first base 7, a link 28 rotatably provided at an upper end of said supporting shaft 27 and a turnbuckle 29 pivoted between an end portion of said link 28 to bottom plates of the respective frames 19, a pair of group of signs-conveying members 10 being adapted to contrarily approach to and separate from each other. Said driving mechanism 26 is composed of, for example, an oil pressure cylinder and a cylinder rod 26*a* connected with one of the frames 19.

Referring to FIGS. 1 to 3 again, reference numeral 30 designates a pair of sign-receiving means arranged at a sign-separating position (B) at a conveying end of the conveying members 10 for going between the bottom portions of the lower two signs of the group (A) of road signs to support the upper road sign (a) during the time when the signs are being installed and supporting the road sign (a) which is retrieved in turn during the time when the signs are being retrieved.

Figure 8:
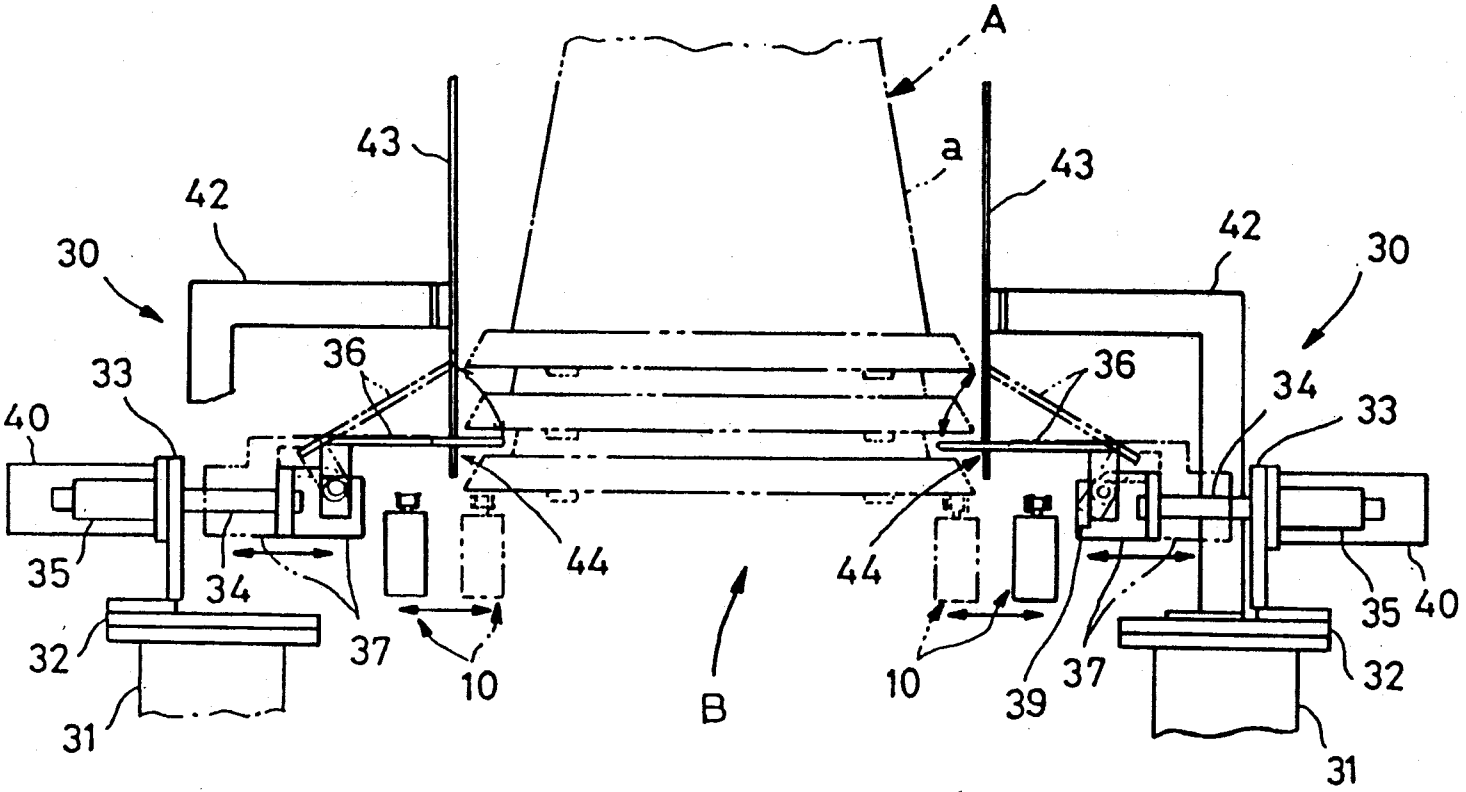
FIG. 8 is a detail drawing showing sign-receiving means.
Figure 9:
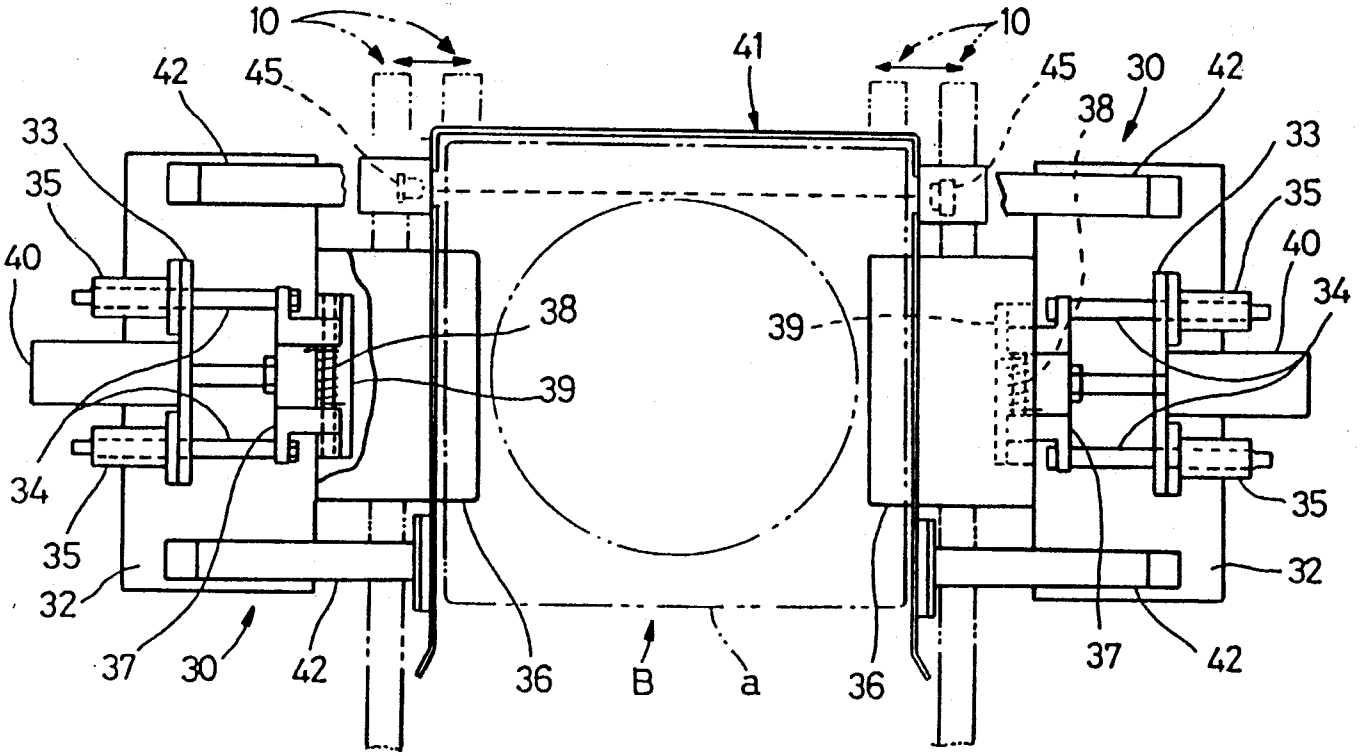
FIG. 9 is a plan view showing said sign-receiving means.

As shown in FIGS. 8, 9, supports 31 stand on both sides of said sign-separating position (B) on said second base 8, a bracket 33 standing on a base plate 32 at an upper end of said support 31, said bracket 33 being provided with a guide cylinder 35 having a guide rod 34 extending through the bracket 33, and said guide rod 34 being provided with a fitting member 37 on which a plate-like sign-receiving member 36 is pivoted swingably up and down so that said sign-receiving members 36 can be caused to approach and separate from each other in a direction the same as the moving direction of the group of signs-conveying member Energizing means (for example a coil spring) 38 is provided in a pivoting portion for swingably energizing the sign-receiving member 36 downward and said fitting member 37 is provided with a stopper 39 for holding the sign-receiving member 36 in a horizontal posture against the force of said energizing means 38.

On the other hand, said fitting member 37 is provided with moving means 40, for example an oil pressure cylinder, connected therewith so that the sign-receiving member 36 held in said horizontal posture may be changed between to a condition in which it goes between the bottom portions of the lower two road signs (a) of the group (A) of road signs conveyed to the sign-separating position (B) and a condition in which it is retracted therefrom.

Referring to FIGS. 8, 9, reference numeral 41 designates a tumbling-preventing member for preventing the group (A) of road signs from tumbling and is mounted on said base plate 32 through a bracket 42, opposite plate portions 43 of said tumbling-preventing member 41 being provided with a retreating opening 44 for the sign-receiving member 36 and an optical sensor 45 for detecting the existence of the group (A) of road signs at the sign-separating position (B).

Referring to FIGS. 1, 2 again, reference numeral 46 designates sign-ascending and descending means for causing the road signs (a) to ascend and descend at the sign-separating position (B) and the second base 8 is provided with a longitudinal bracket 47 on both sides of a sign-conveying center on the side of the loading platform 3, said bracket 47 being provided with two shafts 48 mounted thereabove and therebelow, respectively, the respective shafts 48 being provided with sprockets 49 mounted on both ends thereof, and an endless chain 50 being wound around the respective upper and lower four sprockets 49.

A sign-supporting member 51 positioned within a hollow inside of the road sign (a) to support the road sign (a) is provided on two arms 52 connected therewith, said arms 52 being connected with said chain 50, driving revolving means (for example an oil pressure motor) 53 being carried on the second base 8, and a chain type transmission mechanism 54 being extended over said driving revolving means 53 and said two lower shafts 48.

Figure 10:
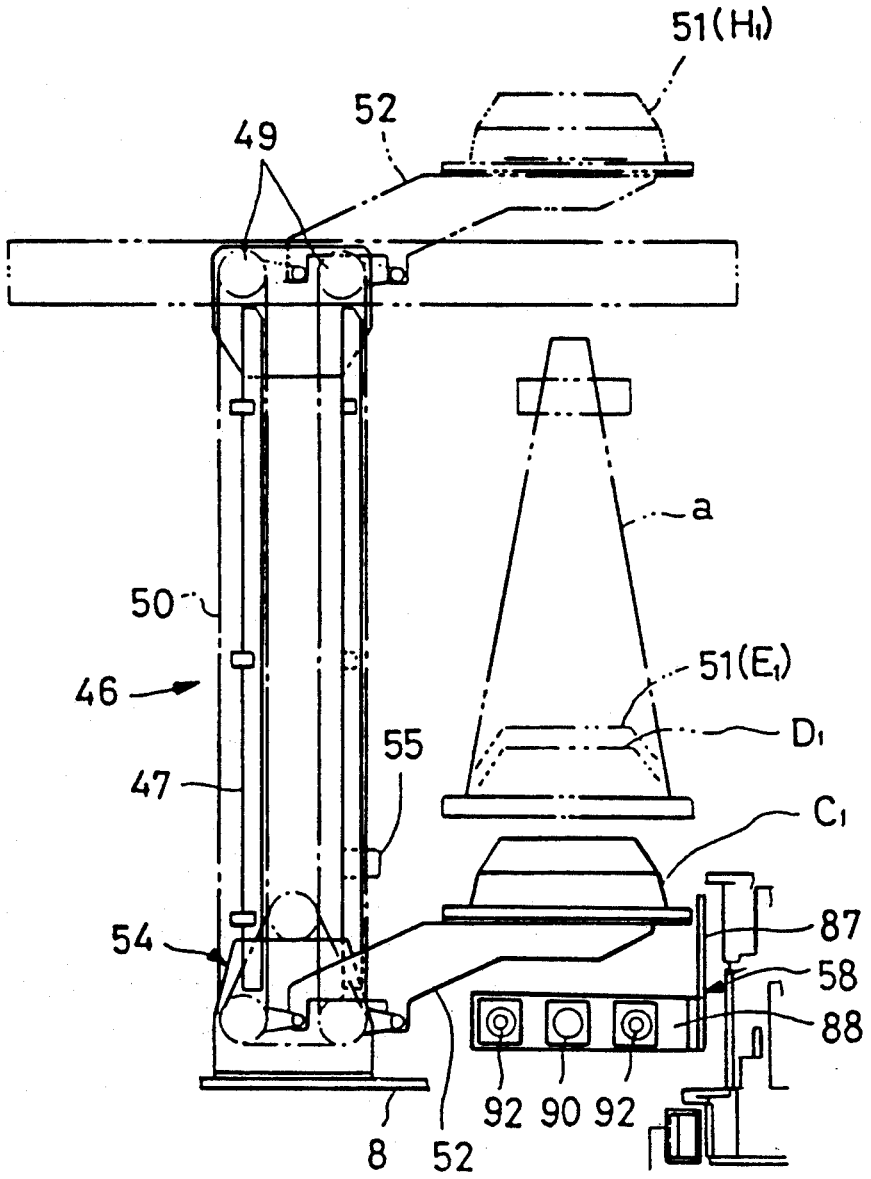
FIG. 10 is a side view showing sign-ascending and descending means.
Figure 11:
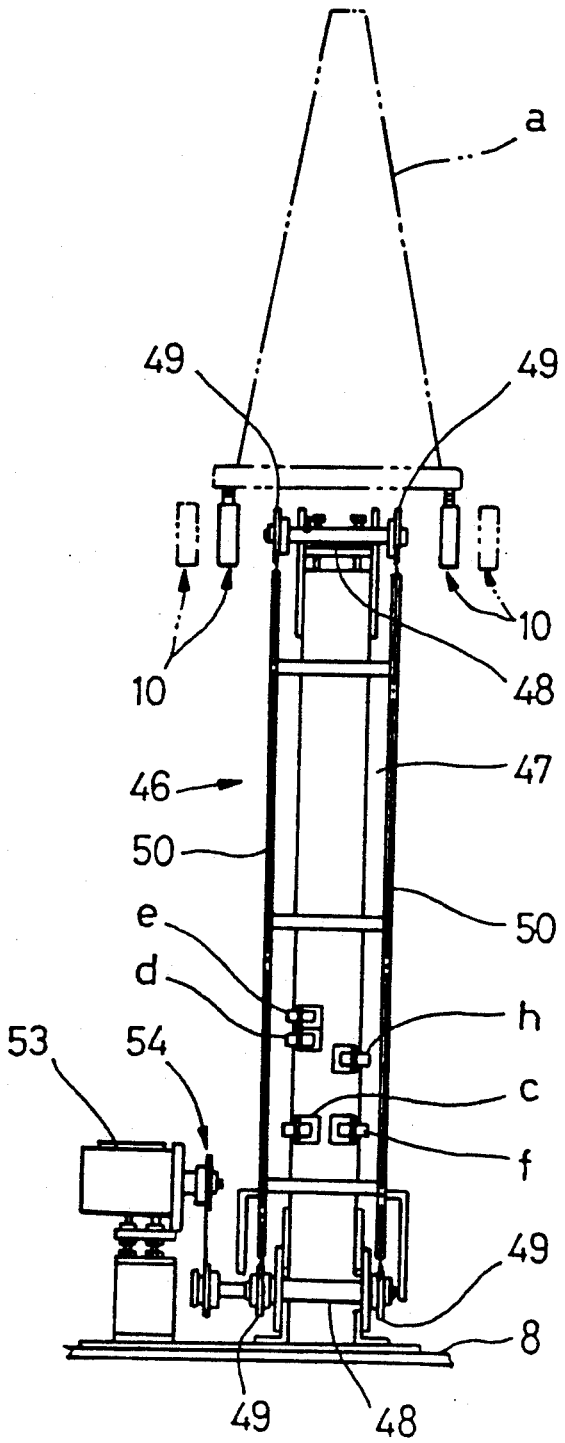
FIG. 11 is a rear view showing said sign-ascending and descending means.
Figure 12:
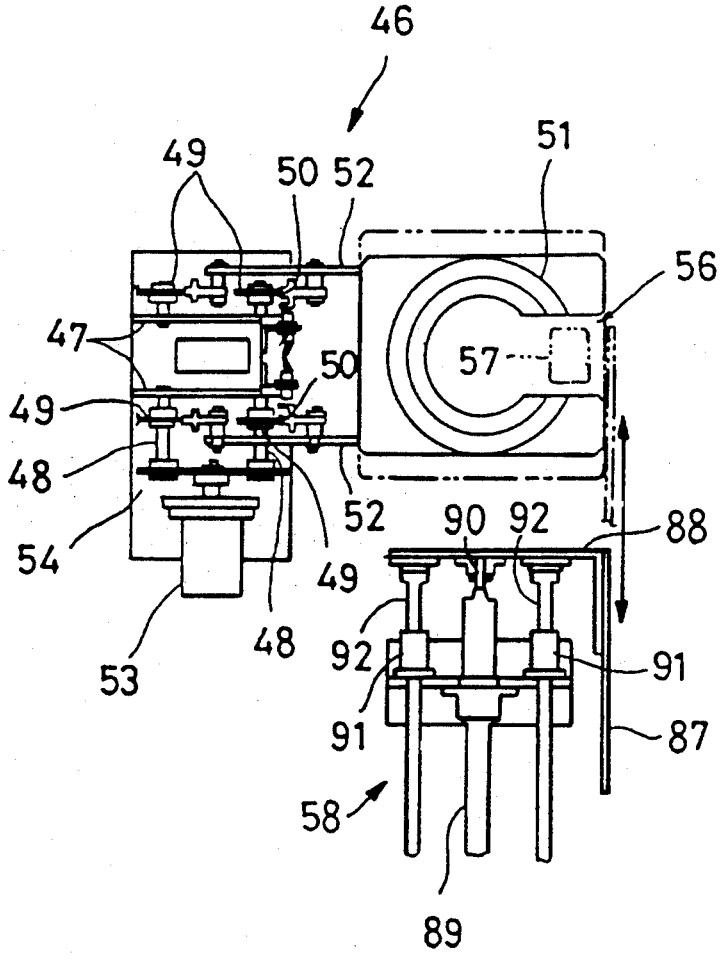
FIG. 12 is a plan view showing the sign-ascending and descending means.

In addition, referring to FIGS. 10 to 12, (c) to (h) designate control switches and the chain 50 is provided with operating members 55 for said switches (c) to (h) so that said sign-supporting member 51 may be stopped at five positions in the up and down direction.

Furthermore, referring to FIG. 12, reference numeral 56 designates an opening for passing a bottom portion of sign-supporting member 57, which will be described later, therethrough and formed in the sign-supporting member 51.

Figure 13:
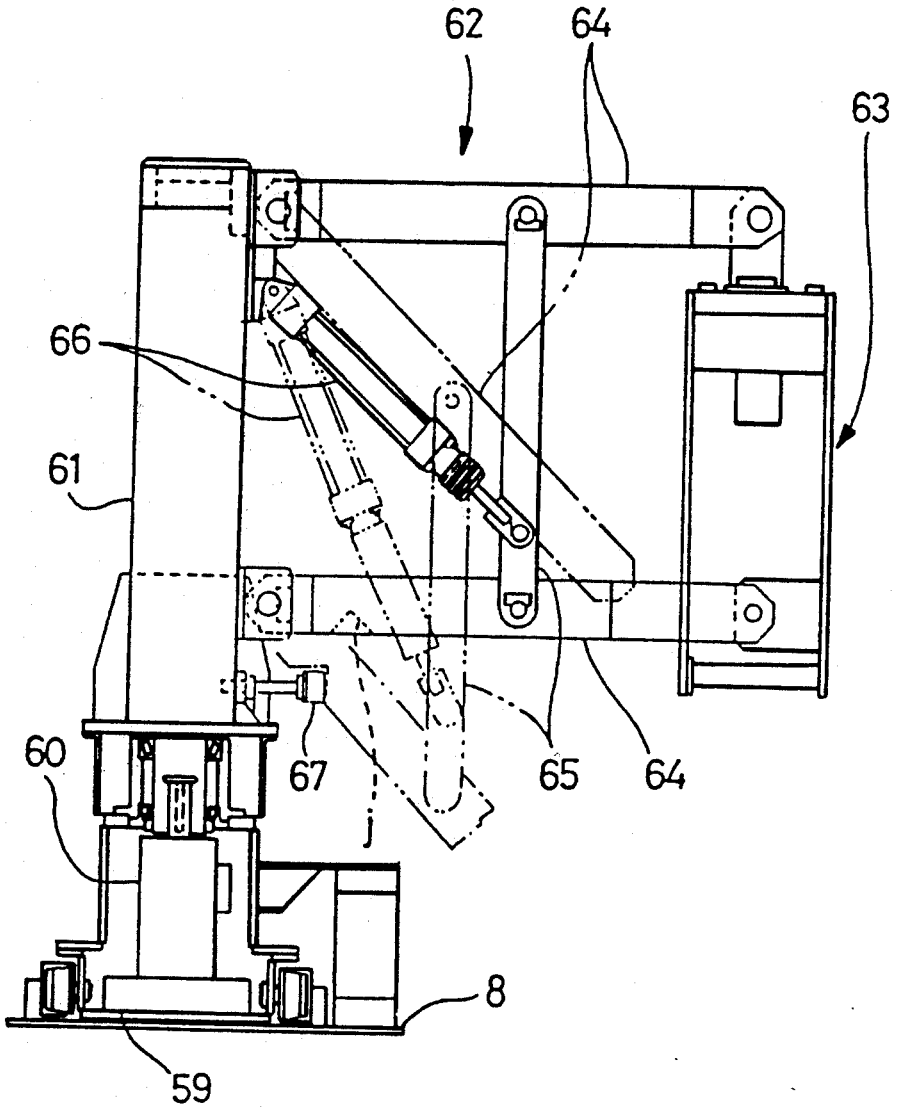
FIG. 13 is a detail drawing showing a holding means-ascending and descending mechanism.
Figure 15:
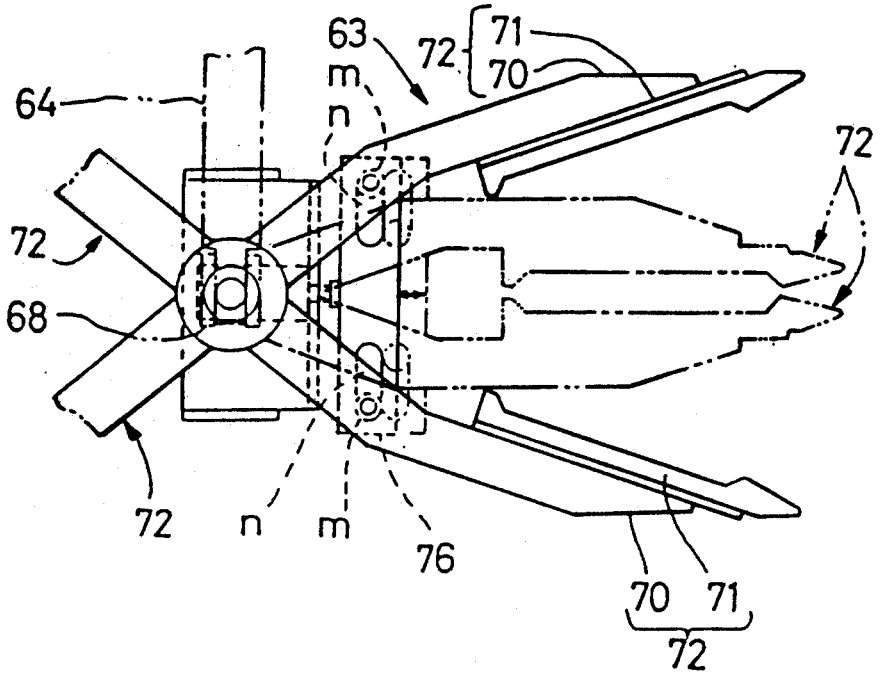
FIG. 15 is a plan view showing said sign-holding means.
Figure 16:
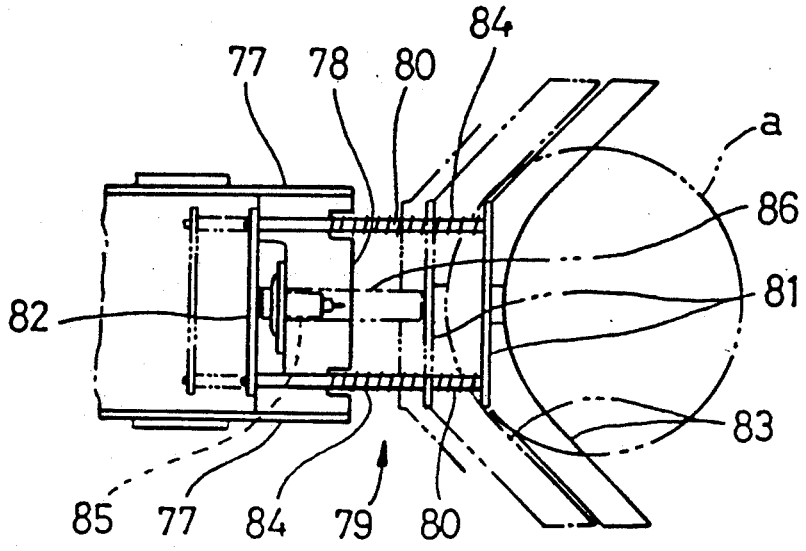
FIG. 16 is a plan view showing a trunk-supporting

Referring to FIG. 1 again, reference numeral 58 designates posture-correcting means for correcting a posture around a vertical axis of the road sign (a) supported by the sign-supporting member 51 and reference numeral 59 designates a truck reciprocatable in the direction of width of the second base 8 composing position-changing means for changing the position, where the road sign is installed and retrieved, from one longitudinal side $L_1$ to the other longitudinal side R of the car body. And, said truck 59 is provided with a post 61 driven and revolved around said longitudinal axis by means of revolving means (for example an oil pressure motor) 60, as shown in FIG. 13, and said post 61 is provided with sign-holding means 63 through a sign-holding means-ascending and descending mechanism 62, as shown also in FIGS. 14 to 16.

Said Sign-holding means-ascending and descending mechanism 62 has a parallel four link structure and comprises a pair of links 64 (an upper link and a lower link) pivoted on the post 61 to be swingable up and down, a longitudinal link 65 pivoted between said upper and lower links 64 and ascending and descending means 66, for example an oil pressure cylinder, connected between said longitudinal link 65 and the post 61. In addition, reference numeral 67 designates a position-regulating stopper to be engaged with a triangular concave portion (j) formed in the lower link 64 for regulating the descending position of the sign-holding means 63 and preventing the sign-holding means 63 from being vibrated.

The sign-holding means 63 is installed between idle end extensions of the upper and lower links 64 in said sign-holding means-ascending and descending mechanism 62. A vertical member 68 is pivotably connected with said idle end extensions of the upper and lower links 64 and provided with two grip members 70 crossing at a point rotatable around a vertical shaft 69 on an upper portion thereof.

Said grip members 70 are provided with an elastic member 71 on the respective free ends thereof to form two sign-holding grips 72, a shaft member 73 provided with a roller follower (m) at a lower end thereof being connected with a revolving base portion side of the respective grip members 70, a bracket 75 connected with the vertical member 68 being provided with expanding and contracting means 74, for example an oil pressure cylinder, and a member 76 provided with elongated holes (n), in which said roller followers (m) are engaged, being connected with said expanding and contracting means 74 so that said sign-holding grips 72 can be changed over to a sign-holding condition and a releasing condition by means of the expanding and contracting means 74.

Figure 14:
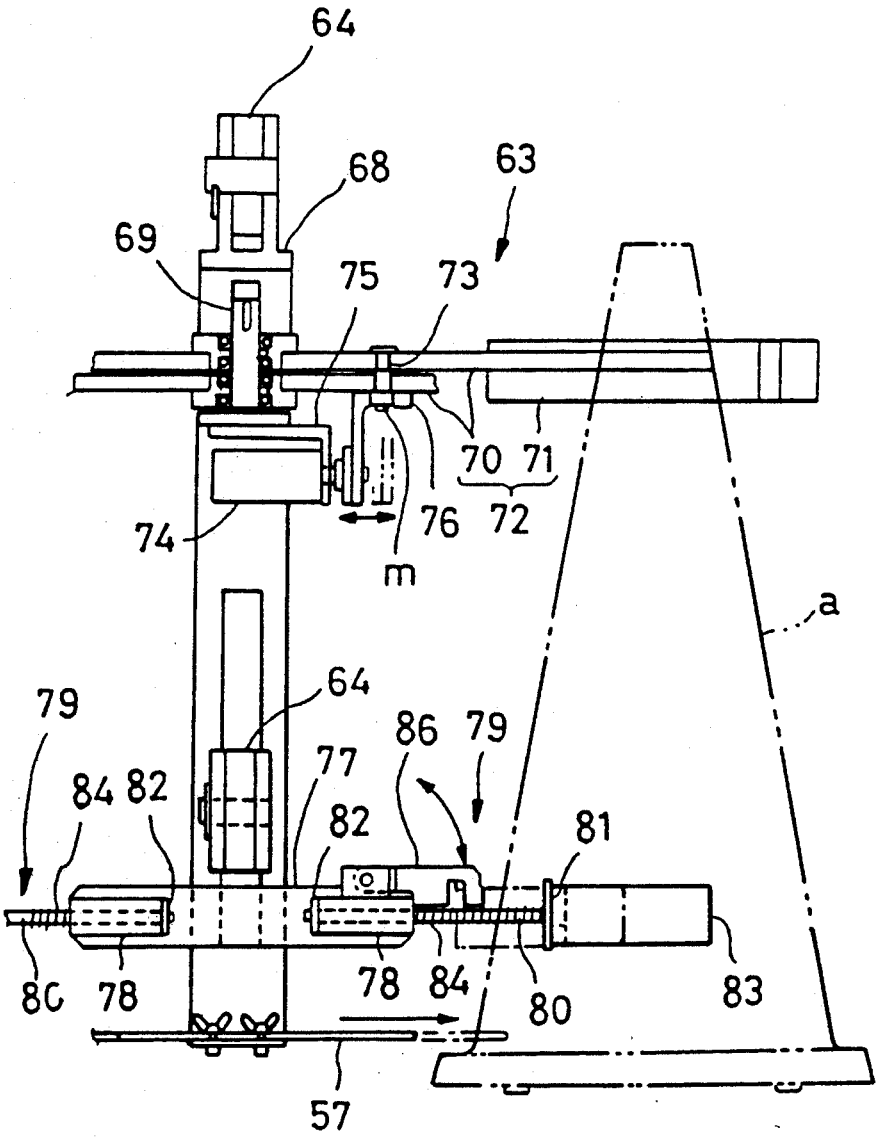
FIG. 14 is a detail drawing fractioned in main parts showing sign-holding means.

Referring to FIG. 14, reference numeral 57 designates a bottom portion of the sign-supporting member provided so as to be shifted between fixed positions in the travelling direction of the travelling car body 2 for supporting one side of the bottom portion of the road sign (a). As shown also in FIG. 16, reference numeral 77 designates two brackets connected with a lower portion of the vertical member 68, a block 78 being connected between free ends of both brackets 77, respectively, and two trunk-supporting mechanisms 79 (only one set is shown) for the lower portion of the sign being provided on both a front side and a rear side in the travelling direction of the car body 2 of the respective blocks 78.

Said trunk-supporting mechanism 79 comprises two rods 80 provided slidably in the travelling direction of the travelling car body 2 on the blocks 78, plate-like members 81, 82 mounted between end portions of both rods 80, a bent support member 83 provided on the outer side of said plate-like member 81 for supporting a trunk portion of the lower portion of the sign and energizing means 84 for projectedly moving said support member 83.

The support member 83 is slightly moved against said energizing means 84 when engaged with the road sign (a) installed on the road surface. A sign-detecting sensor 85 detecting an existence of the road sign (a) on the basis of said movement of the support member 83 is provided.

In addition, referring to FIG. 14, reference numeral 86 designates a locking member engageable with the plate-like member 81, with which the support member 83 is connected, under the condition that the support member 83 is shifted to a great extent against the energizing means 84 for holding the support member 83, which is unnecessary during the installation of the road sign (a), in a non-operating condition.

Said posture-correcting means 58 for correcting a posture of the sign (a) when the retrieved road sign (a) is inclined comprises a member 87, which is engaged with a side edge of the bottom portion of the road sign (a) to correct said posture of the road sign (a), mounted on an L-shaped member 88, a cylinder rod 90 of driving means 89, for example a cylinder, connected with said L-shaped member 88 and a guide rod 92, which is guided by a guide cylinder 91, connected with the L-shaped member 88.

Figure 17:
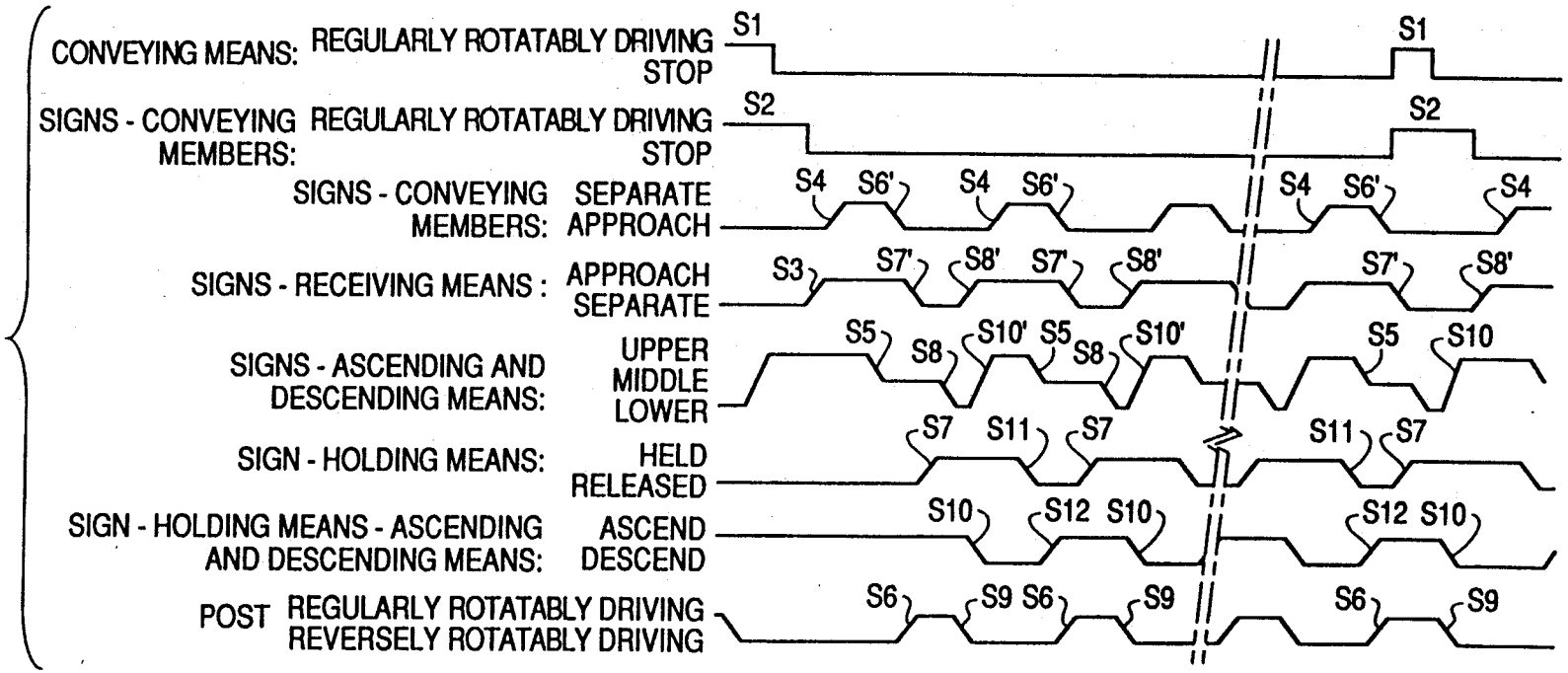
FIG. 17 is a diagram of a cycle for installing road signs.

An installing and retrieving operation of a road sign (a) by the apparatus for installing and retrieving road signs having the above described construction will be described below with reference to cycle diagrams shown in FIG. 17, 19.

Figure 18:
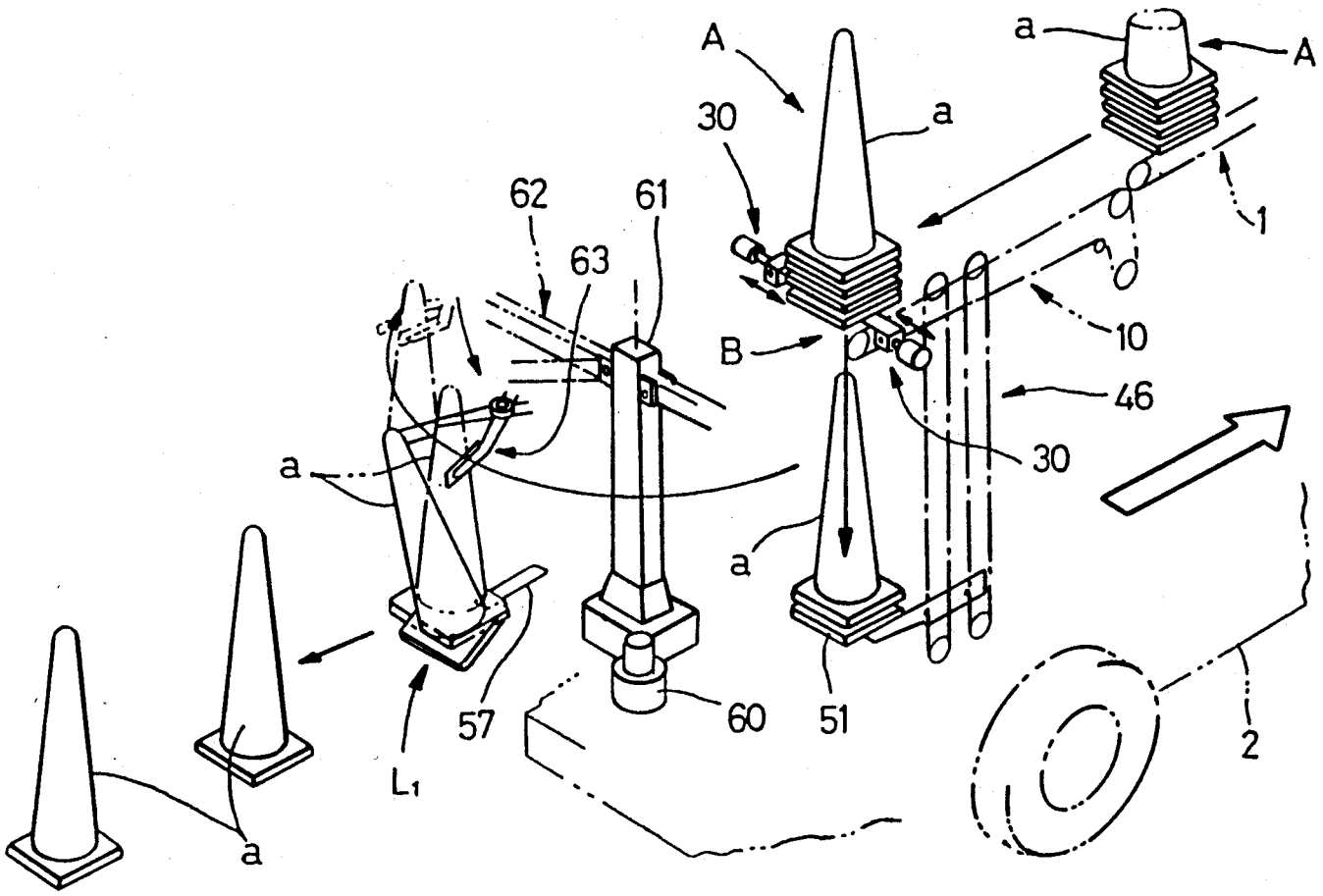
FIG. 18 is a diagram showing an operation of installing road signs.
Figure 19:
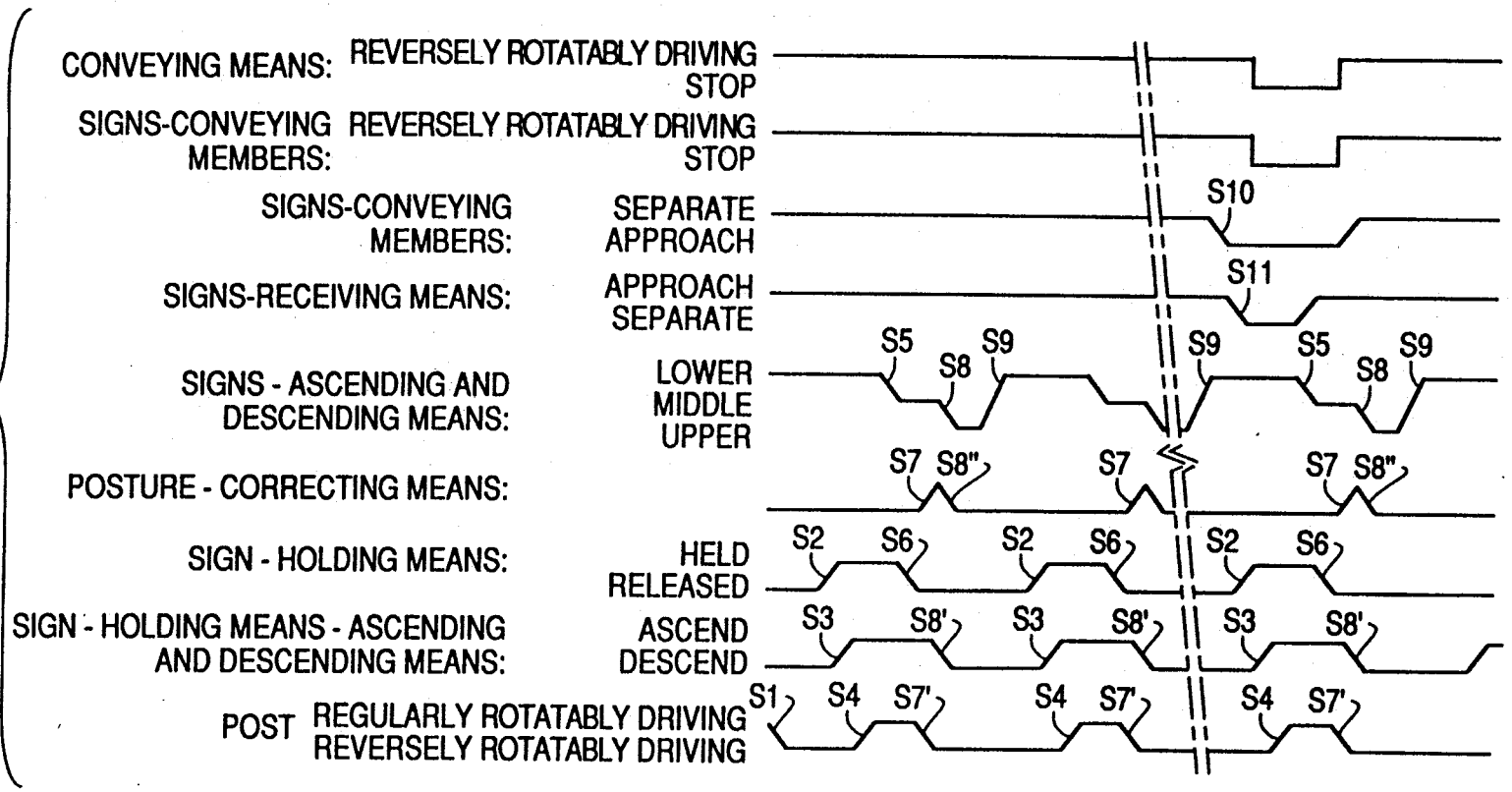
FIG. 19 is a diagram of a cycle for retrieving road signs.
Figure 20:
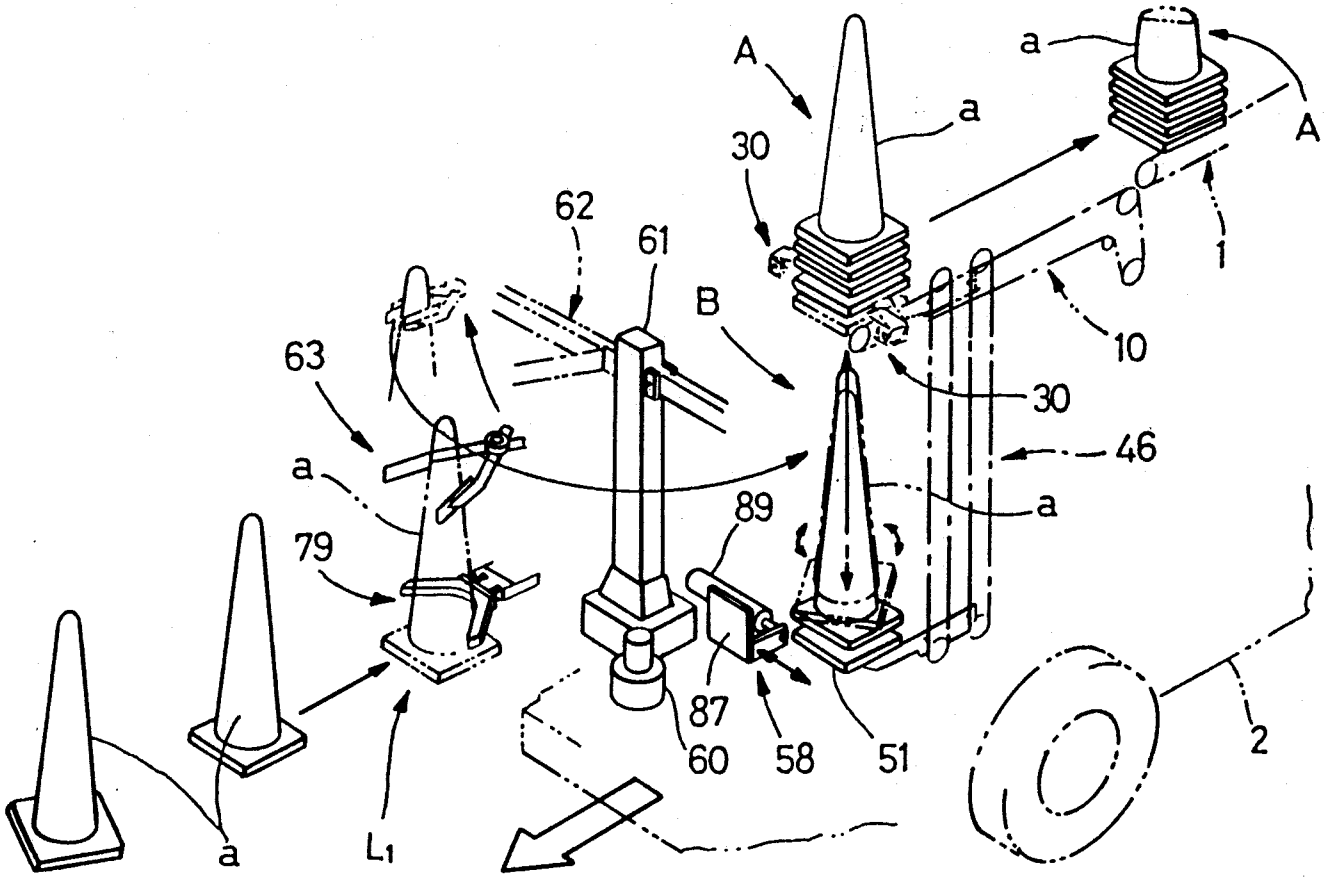
FIG. 20 is a diagram showing an operation of retrieving road signs.

At first, as to an installation of the road sign (a), said installation of the road sign (a) is carried out by a forward travel of the travelling car body 2 in the following manner, as shown in FIG. 18. In addition, the support member 83 is locked in the non-operating condition and said bottom portion of sign-supporting member 57 is projected to a bottom portion-receiving position and fixed.

Upon regularly driving the conveying means 1 and the group of signs-conveying members 10 (step S 1, S 2) to convey the first group (A) of road signs on the conveying means 1 to a pair of group of signs-conveying members 10, the conveying means 1 is stopped by an action of a sensor 93 (refer to FIG. 2) and the group of signs-conveying members 10 are stopped by an action of a sensor 45 (refer to FIG. 9) at a point of time when the group (A) of road signs arrives at the sign-separating position (B).

Here, as shown by full lines in FIG. 8, the sign-receiving members 36 of a pair of sign-receiving means 30 are changed over to the condition that they go between the bottom portions of the lower two signs of the group (A) of road signs (step S 3) an a pair of group of signs-conveying members 10 are separated from each other to be changed over to be condition that the holding of the signs is released (step S 4), thereby separating the lowermost sign (a) to let if fall.

The fallen road sign (a) is, as shown in FIGS. 10, 11, received by the sign-supporting member 51 of the sign-ascending and descending means 46 positioned at an upper position $E_1$ during the retrieval of signs by means of the approach switch (e) and the sign-ascending and descending means 46 is lowered until the approach switch (d) acts to stop the sign-supporting member 51 at a middle position $D_1$ (step S 5).

Subsequently, the post 61 is regularly driven to change over the sign-holding means 63 existing at said installing retrieval position $L_1$ to the sign-separating position (B) (step S 6), the road sign (a) being held by the sign-holding grips 72 of the sign-holding means 63 (step S 7), and the sign-ascending and descending means 46 being lowered until the approach switch (c) acts to stop the sign-supporting member 51 at a lower position $C_1$ and being drawn from said hollow space inside of the road sign (a) (step S 8). Subsequently, the post 61 is reversely rotatably driven to change over the sign-holding means 63 to the installing-retrieval position $L_1$ (step S 9), the sign-holding means-ascending and descending mechanism 62 being downwardly driven midway of the rotation of the post 61 (step S 10), and the sign-holding grips 72 of the sign-holding means 63 being changed over to the sign-releasing condition (step S 11) followed by upwardly driving the sign-holding means-ascending an descending mechanism 62 (step S 12) to complete the installation of a road sign (a). The road sign (a) is first brought into contact with the ground on the rear side in the travelling direction of the travelling car body 2 under the condition that it is supported only by means of the bottom portion of the sign-supporting member 57 and at the almost same time the bottom portion of the sign-supporting member 57 is drawn from the bottom of the sign to position the sign on the road surface.

At this time, the road sign (a) has inertia in the travelling direction, so that it is not tumbled even though it is first brought into contact with the ground on the rear side in the travelling direction of the travelling car body 2 under the sole-supported condition and the inertia force acts upon the road sign (a) in the drawing direction of the bottom portion of the sign-supporting member 57, whereby the road sign (a) is positioned at an appointed position without being tumbled.

During the above described steps S 6 to S 10, the pair of group of signs-conveying members 10 are caused to approach each other to change over to the sign-receiving posture (step S 6'), the sign-receiving members 36 of the sign-receiving means 30 are changed over to the retracted condition (step S 7') and then to the sign receiving condition (step S 8,), and the sign-ascending and descending means 46 is driven up to change the sign-supporting member 51 to said upper position E (step S 10') to prepare for the following installation of a sign.

Subsequently, the above-described steps S 4 to S 12 are repeated and the conveying means 1 and the group of signs-conveying members 10 are driven during the steps S 6, S 7 midway during the installation of the final road sign (a) of a group A to convey the following group (A) of road signs to the sign-separating position (B).

The retrieval of the road sign (a) will be described. This retrieval of the road sign (a) is carried out by the rearward travelling of the travelling car body 2 in the following manner. In addition, the support member 83 is changed over to the operating condition, the bottom portion of the sign-supporting member 57 being changed over to the retracted condition, the pair of sign-receiving members 36 of the sign-receiving means 30 being changed to the receiving condition, and the pair of group of sign-conveying members 10 are changed over to the supporting of the sign-releasing condition.

At first, the post 61 is reversely driven to change the sign-holding means 63 at the sign-separating position (B) to the installing-retrieving position $L_1$ (step S 1). As soon as the sensor 85 acts at the time of engaging the support member 83 with the road sign (a) standing on the road surface, the sign-holding grips 72 of the sign-holding means 63 are changed over to the holding condition (step S 2) to hold the road sign (a) by means of the sign-holding grips 72.

Then, the sign-holding means-ascending and descending mechanism 62 is ascendedly driven (step S 3), the post 61 being regularly driven to change over the sign-holding means 63 to the sign-separating position (B) (step S 4), the sign-supporting member 51 of the sign-ascending and descending means 46 being lifted up to said middle position $D_1$ from said lower position $C_1$ (step S 5), and the sign-holding grips 72 of the sign-holding means 63 being changed over to the releasing condition (step S 6) to put the retrieved road sign (a) in the sign-supporting member 51.

Next, the posture-correcting means 58 is driven to correct the position of the road sign (a) if it is not in the correct posture (step S 7) and the sign-supporting member 51 of the sign-ascending and descending means 46 is lifted up to an upper position H (a position above an operating surface of the group of signs-conveying members 10) in a step S 8, whereby the road sign (a) on the sign-supporting member 51 pushes up the sign-receiving members 36 to pass thereby. At the same time, the posture-correcting means 58 is reversely driven (step 8'').

After passing through the sign-receiving members 36 the sign-supporting member 51 of the sign-ascending and descending means 46 is changed over to the lower position $C_1$ at an appointed time (step S 9). Under such condition, the sign-receiving member 36 of the sign-receiving means 30 is changed over to a horizontal posture, so that the road sign (a) is supported by means of the sign-receiving member 36.

On the other hand, at the same time as the above described step S 7, the post 61 is reversely driven to change over the sign-holding means 63 to the installing-retrieval position $L_1$ (step S 7') and the sign-holding means-ascending and descending mechanism 62 is lowered (step S 8'), whereby the sign-holding means 63 prepares for the retrieval of the following road sign (a).

Thereafter, the above described steps S 2 to S 9 including the above described steps S 7', S 8', S 8'' are repeated to retrieve the final road sign (a) to be retrieved. Thereupon, the pair of group of signs-conveying members 10 approach each other so as to be in the sign-receiving posture (step S 10) and the sign-receiving members 36 of the sign-receiving means 30 are separated from each other so as to be in the sign-holding-releasing condition (step S 11), thereby supporting the group (A) of a plurality of retrieved road signs (a) by means of the group of signs-conveying members 10.

The group of signs-conveying members 10 supporting the group (A) of road signs and the conveying means 1 are reversely driven to place the group (A) of retrieved road signs on the conveying means 1.

In addition, although a road sign (a) is supported by means of the bottom portion of the sign-supporting member 57 in the installation of the road sign (a), the bottom portion of the sign-supporting member 57 may be omitted to permit the road sign (a) to fall on the road surface in an upright posture.

Furthermore, although the installation and retrieval of the road signs (a) on one side (the left side in FIG. 3)

of the travelling car body 2 has been described in the above described preferred embodiment, the installation and retrieval of road signs (a) on the other side of the travelling car body 2 can be carried out by moving the truck 59 to the other side of the second base 8 with the post 61 rotatably driven so that the sign-holding means 63 is directed to the rear of the travelling car body 2 and using the other sign-holding grips 72 of the sign-holding means 63. The truck 59 rotatably and ascendably and descendably provided with the sign-holding means 63 composes position-changing means changing the installing-retrieval position of the road signs (a) by the sign-holding means 63 to one longitudinal side $L_1$ or the other longitudinal side $R_1$ of the car body.

Figure 21:
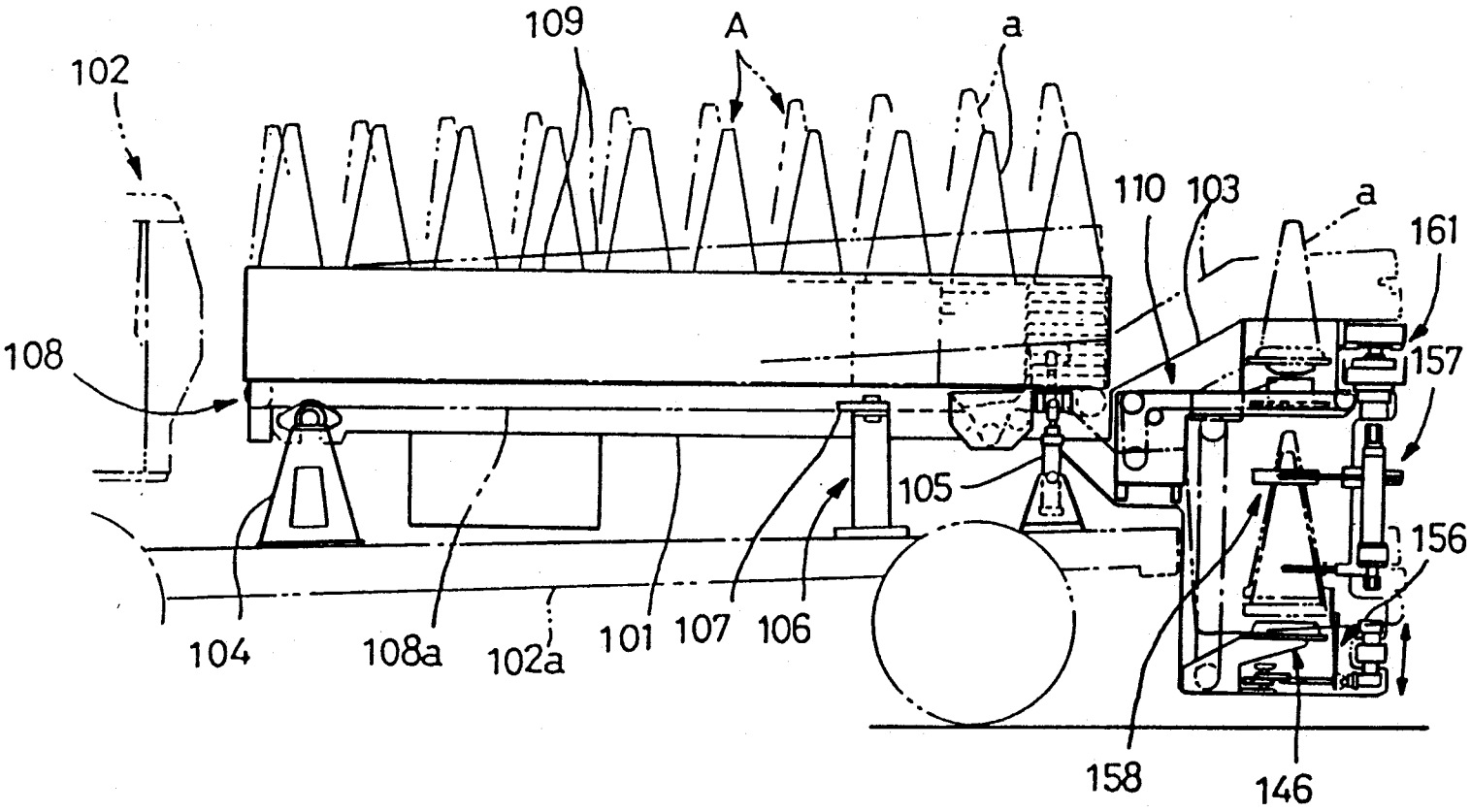
FIG. 21 is a side view showing an apparatus for installing and retrieving road signs.
Figure 22:
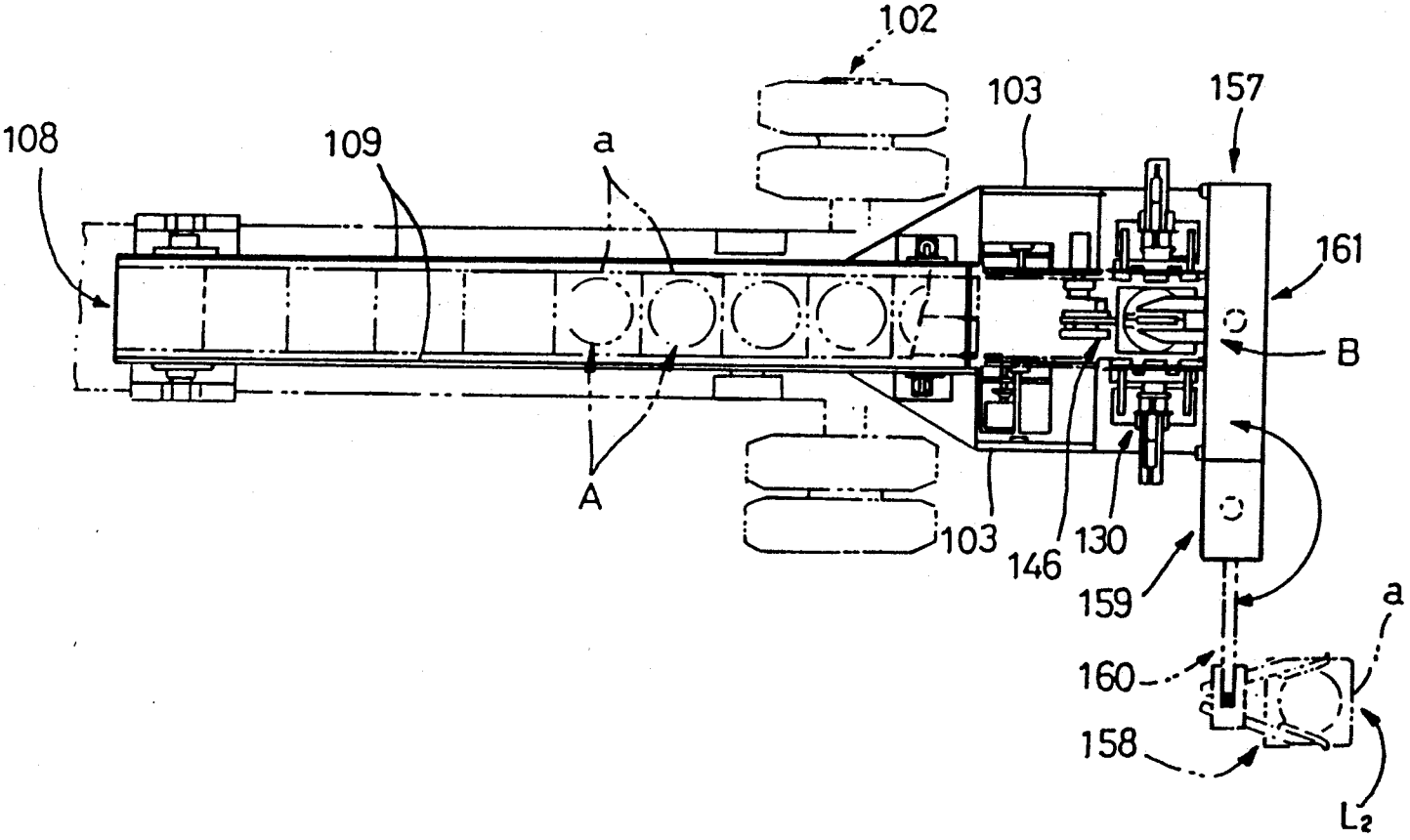
FIG. 22 is a plan view showing said apparatus for installing and retrieving road signs.
Figure 23:
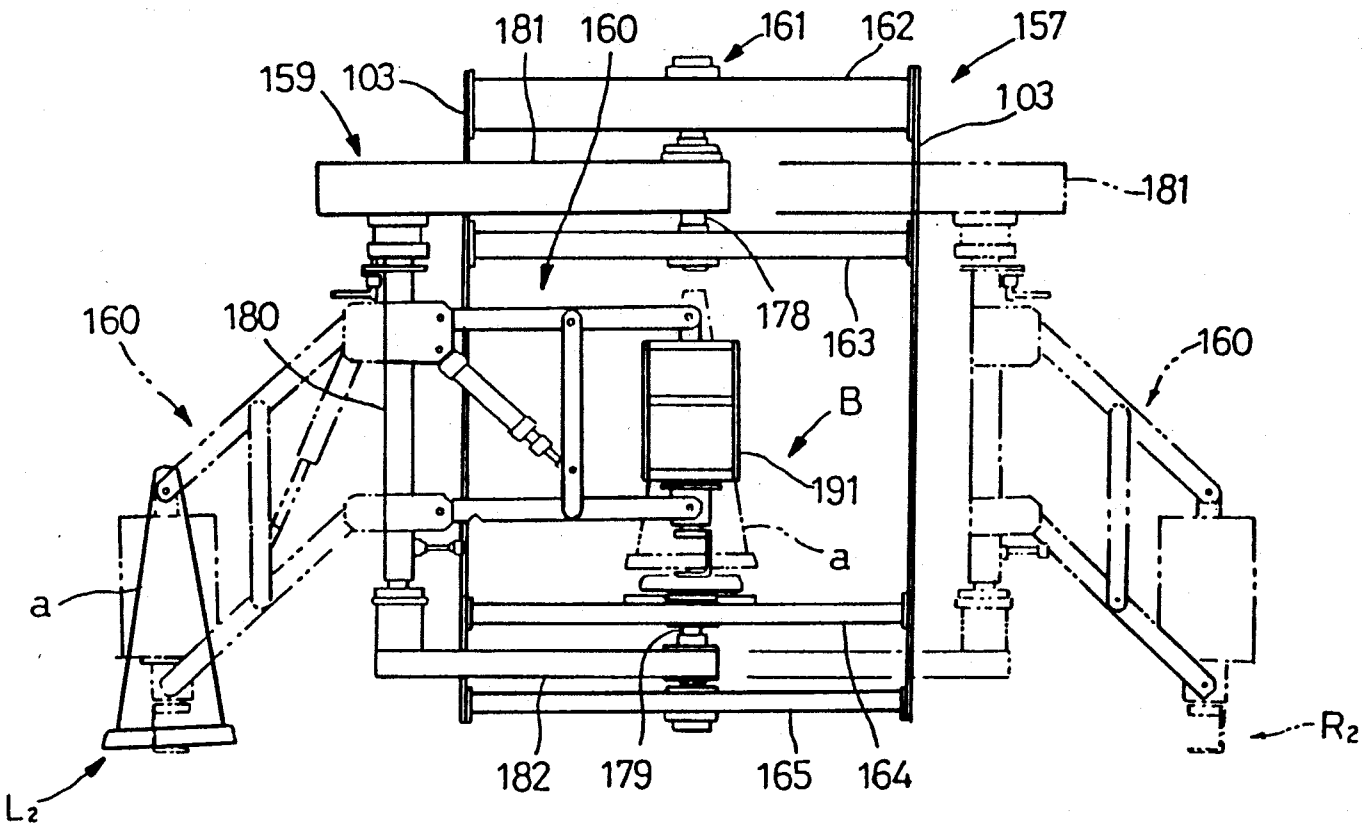
FIG. 23 is a rear view showing the apparatus for installing and retrieving road signs.

The preferred embodiments of the second invention will be described with reference to FIGS. 21 to 41. FIGS. 21 to 23 show an apparatus for installing and retrieving road signs. Referring to FIGS. 21 to 23, reference numeral 101 designates a base carried on a loading platform 102*a* of a travelling vehicle, e.g a car, body 102, said loading platform 102*a* being provided with a pair of longitudinal frames 103, that is a right longitudinal frame and a left longitudinal frame, so as to be extended to a rear portion of said loading platform 102*a*, and said base 101 being pivoted on a support 104 by a horizontal shaft on driver side thereof.

Reference numeral 105 designates a jack for lifting up a rear portion of the base 101 and reference numeral 106 designates receiving means supporting the base 101 lifted up by means of said jack 105 during travel, said receiving means 106 being provided with base-receiving means 107 so that said base-receiving means 107 may be changed over to a receiving condition and a releasing condition.

Reference numeral 108 designates conveying means for a group (A) of a plurality of road signs (a) put one upon another, and is composed of three conveying chains 108*a* conveying said group (A) of road signs while supporting the group (A) of road signs at three places, that is on both sides and a center. A tumbling-preventing member 109 is arranged on both sides of said conveying means 108.

The road signs (a) are composed of a hollow cone portion with an expanded skirt and a flange-like square base projected outward from said skirt of said cone portion and made of a synthetic resin material.

Figure 24:
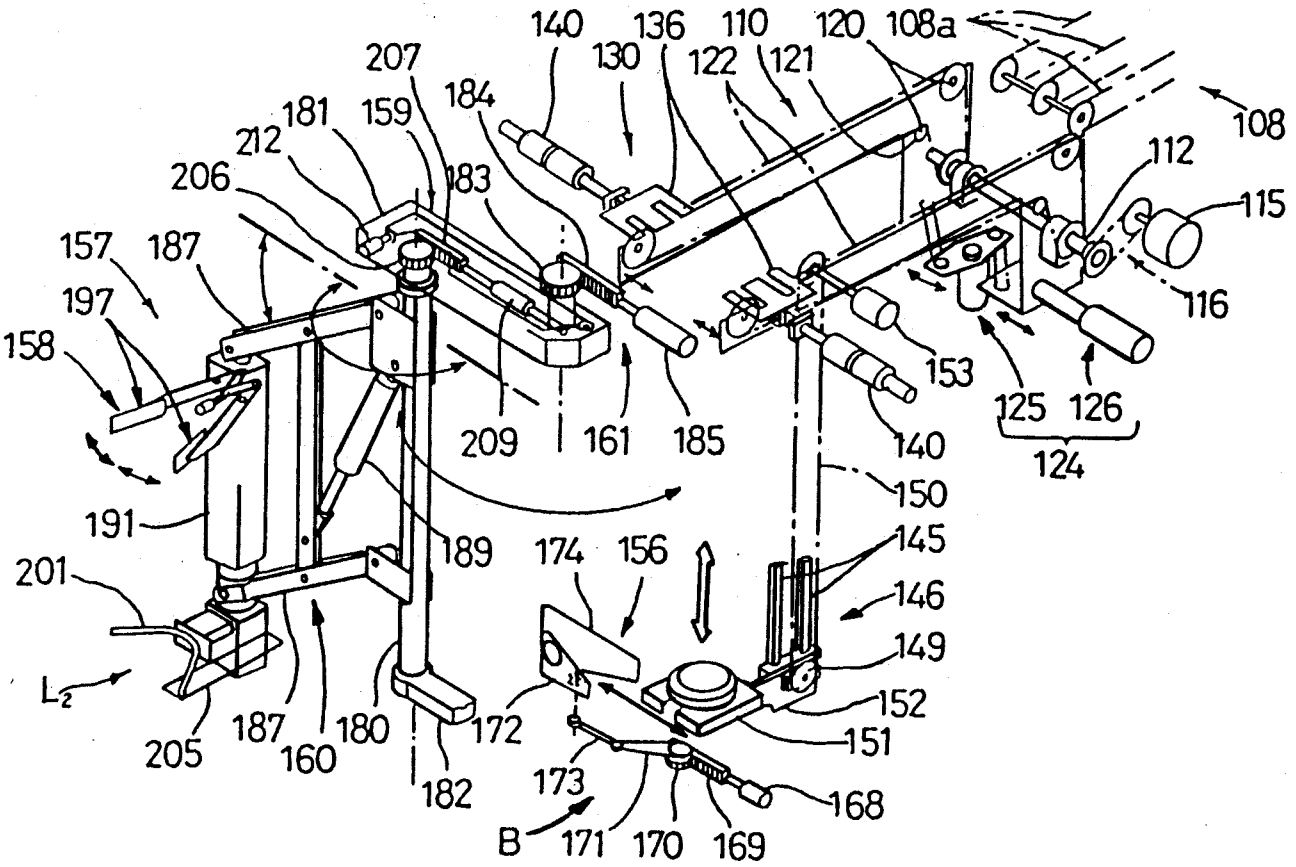
FIG. 24 is a diagram showing an operation of installing and retrieving road signs.
Figure 25:
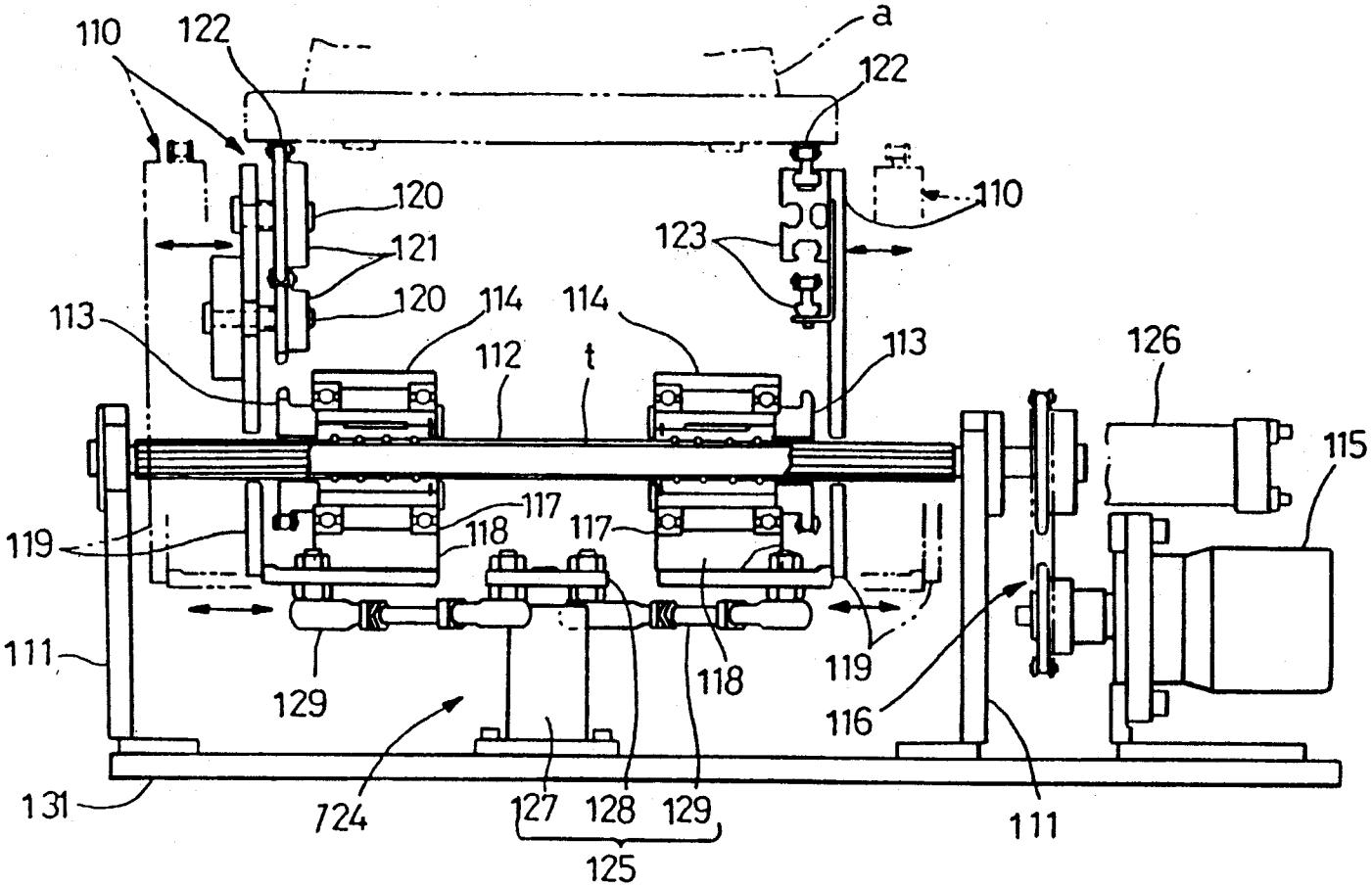
FIG. 25 is a diagram showing a form of a driving system for a group of signs-conveying member.
Figure 26:
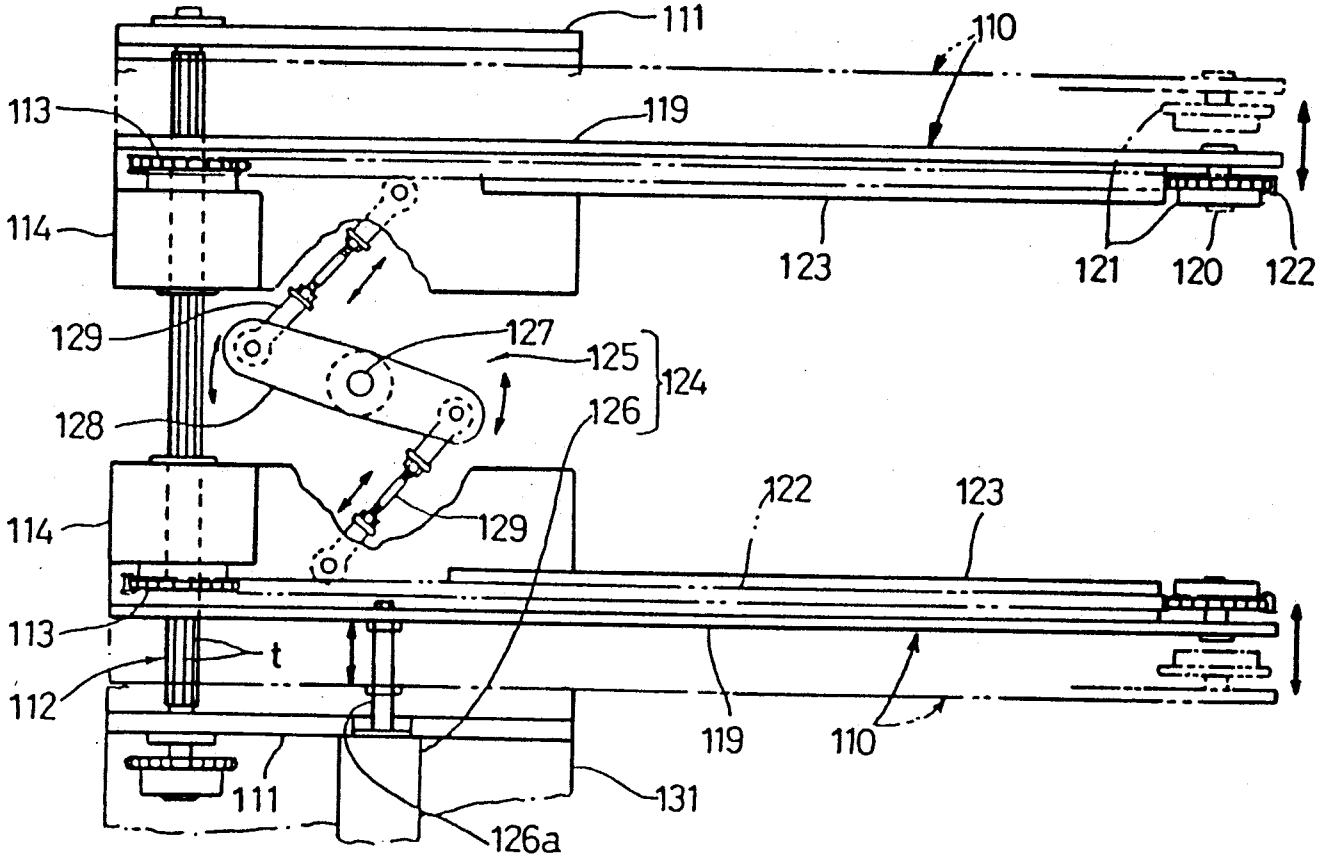
FIG. 26 is a plan view showing said group of signs-conveying member.

Reference numeral 110 designates a pair of group of signs-conveying members conveying the group (A) of signs while supporting the sides of a bottom portion thereof. As shown in FIGS. 24 to 26, a pair of brackets 111 stand on a horizontal frame 131 extending over said pair of longitudinal frames 103, a driving shaft 112 provided with a ball spline groove (t) extending over said pair of brackets 111, and two female spline members 114 connected with a sprocket 113 on the driving side on an outer side portion thereof, respectively, being engaged with said ball spline groove (t).

The driving means 115, for example an oil-pressure pump, is carried on said horizontal frame 131 and a chain-type transmission mechanism extends from said driving means 115 to said driving shaft 112.

A frame-fitting member 118 is supportedly mounted on said respective female spline members 114 by a ball bearing 117, a frame 119 being connected with said frame-fitting member 118 with its idle end projecting toward a rear portion of the loading platform 103, three trailing shafts 120 being installed on the idle end and the base portion of said frame 119 so as to project toward an inner surface, respectively, and a sprocket 121 on the trailing side provided on a projecting end portion of each of the respective trailing shafts 120.

In addition, an endless chain 122 for conveying the group (A) of road signs is wound around said sprocket 113 on the driving side and a sprocket 121 on the trailing side, a guide member 123 supporting a straight portion of said chain 122 being mounted on an inner side surface of the frame 119, and said group of signs-conveying members 110 supporting both sides of said bottom portion of a group (A) of road signs to convey them being adapted to be movable in the direction of the axis of the driving shaft 113.

Reference numeral 124 designates condition-changing over means for causing a pair of group of road sign-conveying members 110 to approach and separate from each other to change between a sign-supporting condition and a releasing condition, said condition-changing over means 124 being composed of an interlocking mechanism 125 for causing the group of signs-conveying members 110 to approach and separate from each other and a driving mechanism 126 for shifting one group of signs-conveying member 110 in said direction of the axis of the driving shaft 113.

Said interlocking mechanism 125 comprises a supporting shaft 127 between the brackets ill of said horizontal frame 131, a link 128 rotatably provided at an upper end of said supporting shaft 127 and a turnbuckle 129 pivoted between an end portion of said link 128 and bottom plates of the respective frames 119, a pair of group of signs-conveying members 110 being adapted to approach and separate from each other. On the other hand, said driving mechanism 126 is composed of, for example, an oil pressure cylinder and a cylinder rod 126*a* connected with one of the frames 119.

Referring to FIGS. 22, 24 again, reference numeral 130 designates a pair of sign-receiving means arranged at a sign-separating position (B) at a conveying end of the conveying members 110 for moving between the bottom portions of the lower two signs of the group (A) of road signs to support the upper road sign (a) during the time when the signs are being installed and supporting the road sign (a) which is retrieved in turn during the time when the signs are being retrieved.

Figure 27:
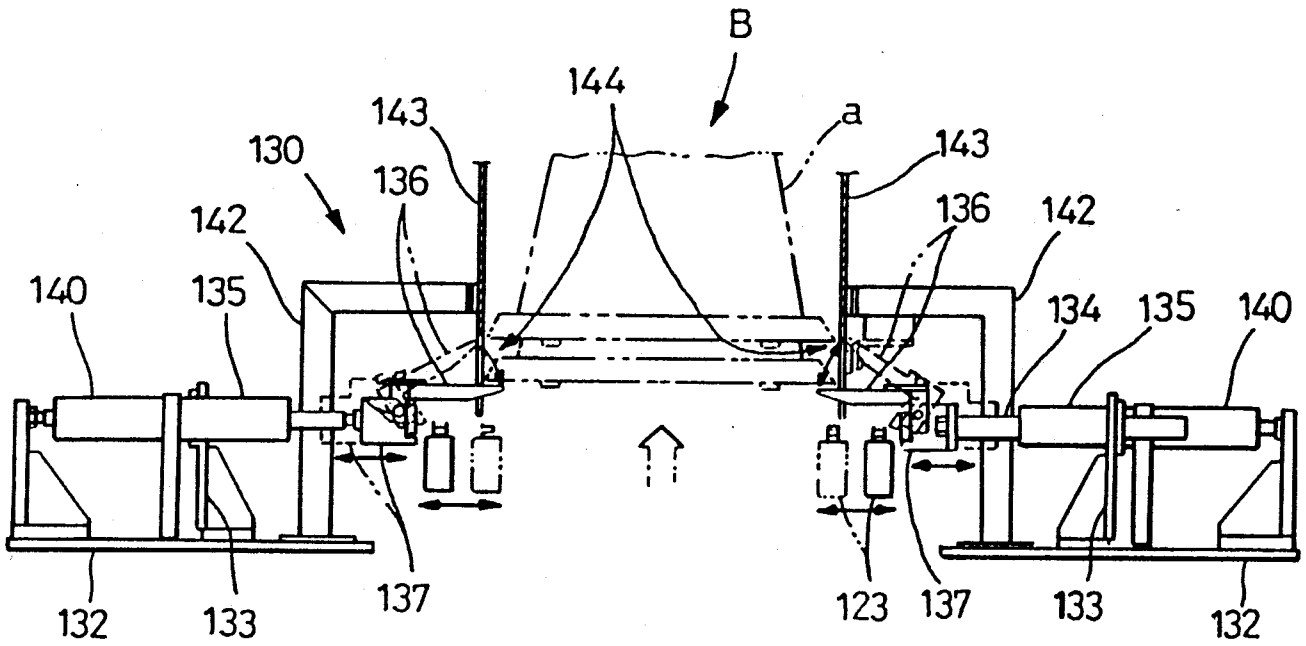
FIG. 27 is a detail drawing showing sign-receiving means.
Figure 28:
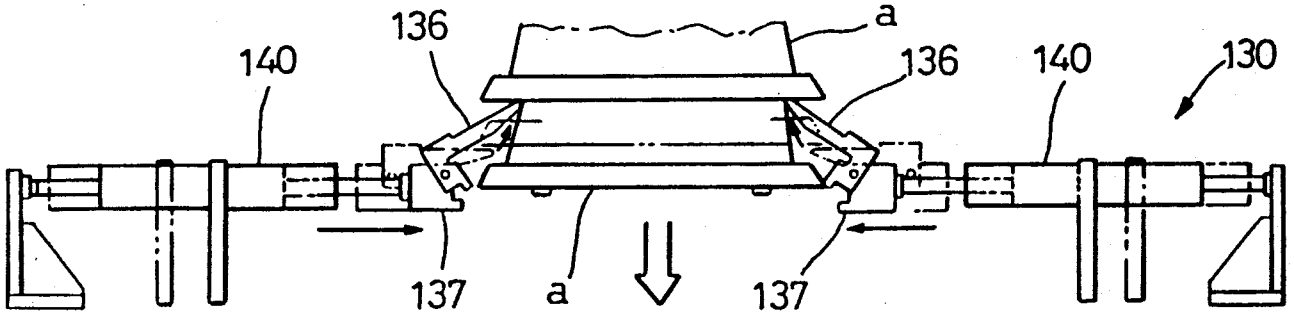
FIG. 28 is a diagram describing a separation of road signs by means of said sign-receiving means.
Figure 29:
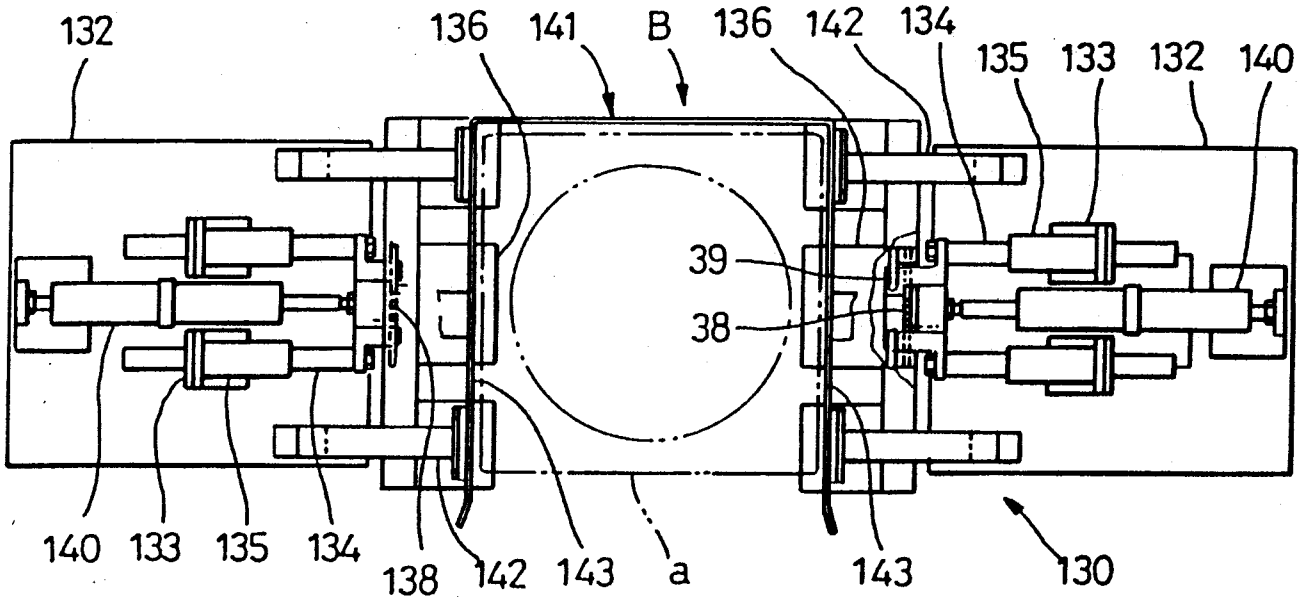
FIG. 29 is a plan view showing the sign-receiving means.

As shown in FIGS. 27 to 29, horizontal brackets 132 on both sides of said sign-separating position (B) are provided with a pair of brackets 133 with a horizontal guide cylinder 135 mounted thereon, a support member 137 being provided over pointed ends of guide rods 134 held within said guide cylinder 135, a plate-like sign-receiving member 136 being pivoted on said support member 137 for swinging up and down, and support member 137 being provided with energizing means (for example a coil spring) 138 for swingably urging the sign-receiving member 136 downward and a stopper 139 for holding the sign-receiving member 136 in a horizontal posture against the force of said energizing means 138.

In addition, a pivoting position of the sign-receiving member 136 is slightly upward biased relative to the axis of said guide rod 134 so that the sign-receiving member 136 will be swung upward when a load is applied to a pointed end of the sign-receiving member 136.

Furthermore, the support member 137 is provided with moving means 140, for example a double-stage expansion and contraction-type oil pressure cylinder, connected therewith so that the sign-receiving member 136 held in said horizontal posture may be changed to a condition that it moves between the bottom portions of the lower two road signs (a) of the group (A) of road signs conveyed to the sign-separating position (B) (refer to FIG. 27) and a condition that when the sign-receiving member 136 is further extended, it is swung up, thereby separating a lower road sign (a) from an upper road sign (a) and allowing said lower road sign (a) to fall (refer to FIG. 28).

Referring to FIGS. 27, 29, reference numeral 141 designates a tumbling-preventing member for preventing the group (A) of road signs from tumbling and mounted on said horizontal frame 131 by a bracket 142 and opposite plate portions 143 of said tumbling-preventing member 141 are provided with a retracting opening 144 for the sign-receiving member 136.

Referring to FIGS. 21, 22, 24, 30, and 31, reference numeral 146 designates sign-ascending and descending means for raising and lowering the road signs (a) at the sign-separating position (B), a longitudinal bracket 147 being provided at the top and bottom with a shaft 148 provided with a sprocket 149, an endless chain 150 being wound around the respective upper and lower sprockets 149, and driving means (for example an oil pressure motor) 153 being interlockedly connected with said upper shaft 148.

Arms 152 ascendable and descendable along guide rails 145 in the up and down direction are provided with a road sign-supporting member 151 connected therewith, a horizontal sliding member 154 being held by means of said arms 152, and pins (i) connected with said endless chain 150 being engaged with said horizontal sliding member 154.

That is to say, the horizontal sliding member 154 is transferred in the horizontal direction integrally with the chain 150 in a portion where the chain 150 is wound around the sprocket 149, thereby raising an lowering a sign-supporting member 151.

Referring to FIGS. 21–24, 30–33, reference numeral 156 designates posture-correcting means for correcting a posture around a vertical axis of the road sign (a) supported by the sing-supporting member 51.

Reference numeral 157 designates means for installing and retrieving road signs (a) composed of sign-holding means 158 releasably holding the road sign (a) therebetween, revolving means 159 revolving said sign-holding means 158 between the road sign (a)-separating position (B) midway of the car body and a (a)-installing-retrieval position $L_2$ on one road sign longitudinal side of the car body, a sign-holding means-ascending and descending mechanism 160 raising and lowering the sign-holding means 158 at said road sign (a)-installing-retrieval position $L_2$ and position-changing means 161 changing the road sign (a)-installing-retrieval position $L_2$ of the sign-holding means 158 to the other longitudinal side $R_2$ of the travelling car body 102.

Figure 30:
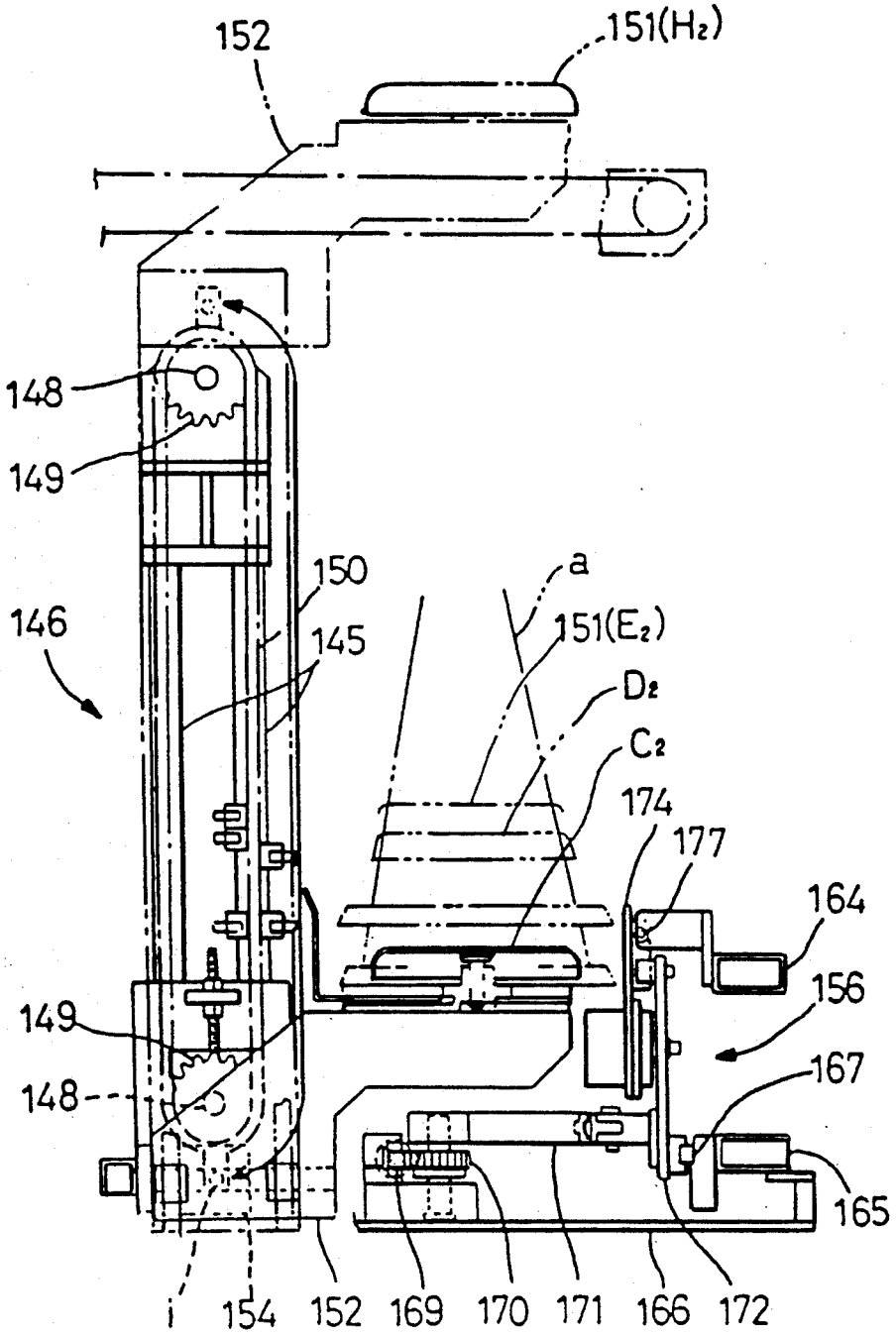
FIG. 30 is a side view showing sign-ascending and descending means.
Figure 31:
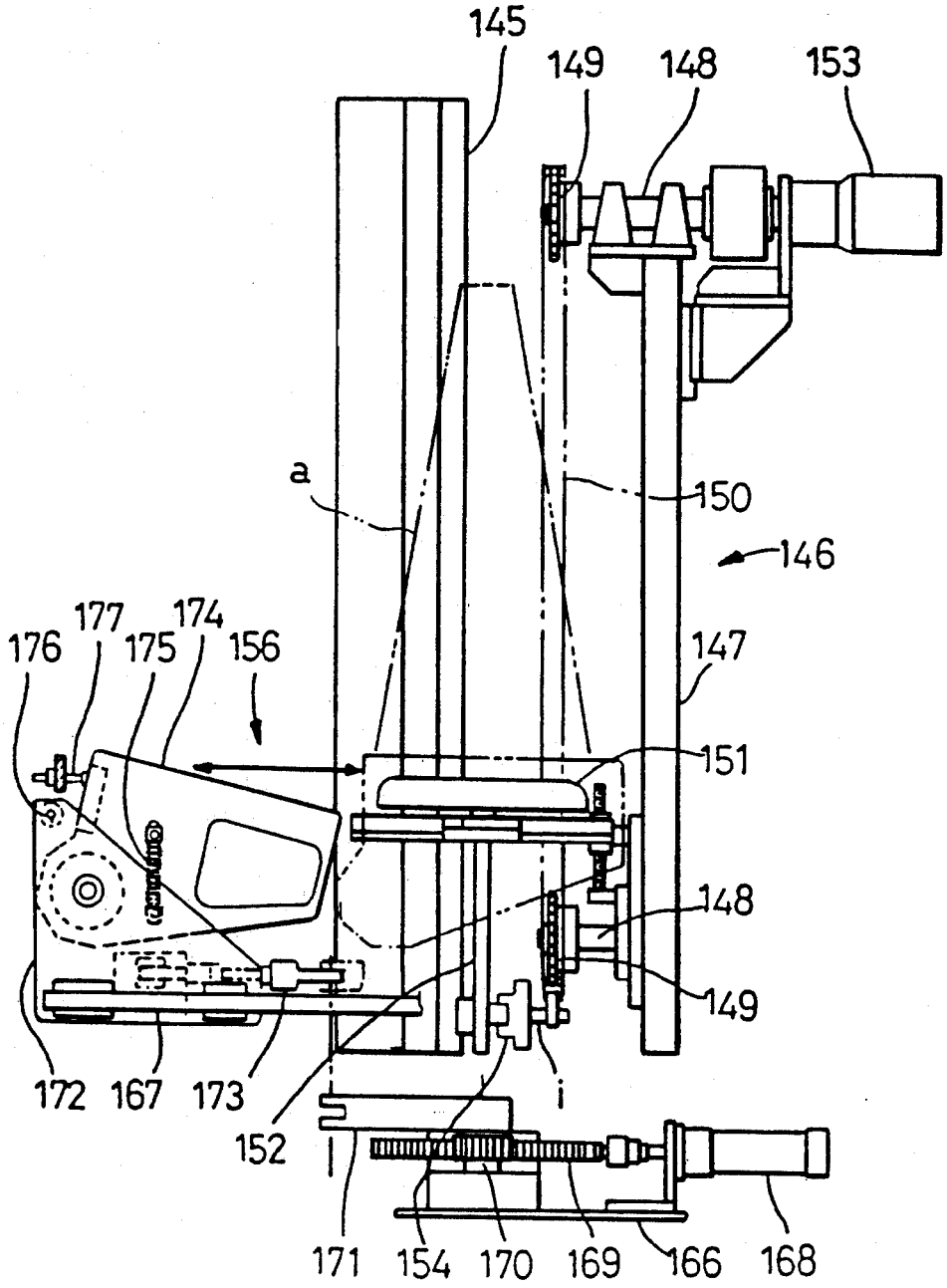
FIG. 31 is a detail drawing showing posture-correcting means.
Figure 32:
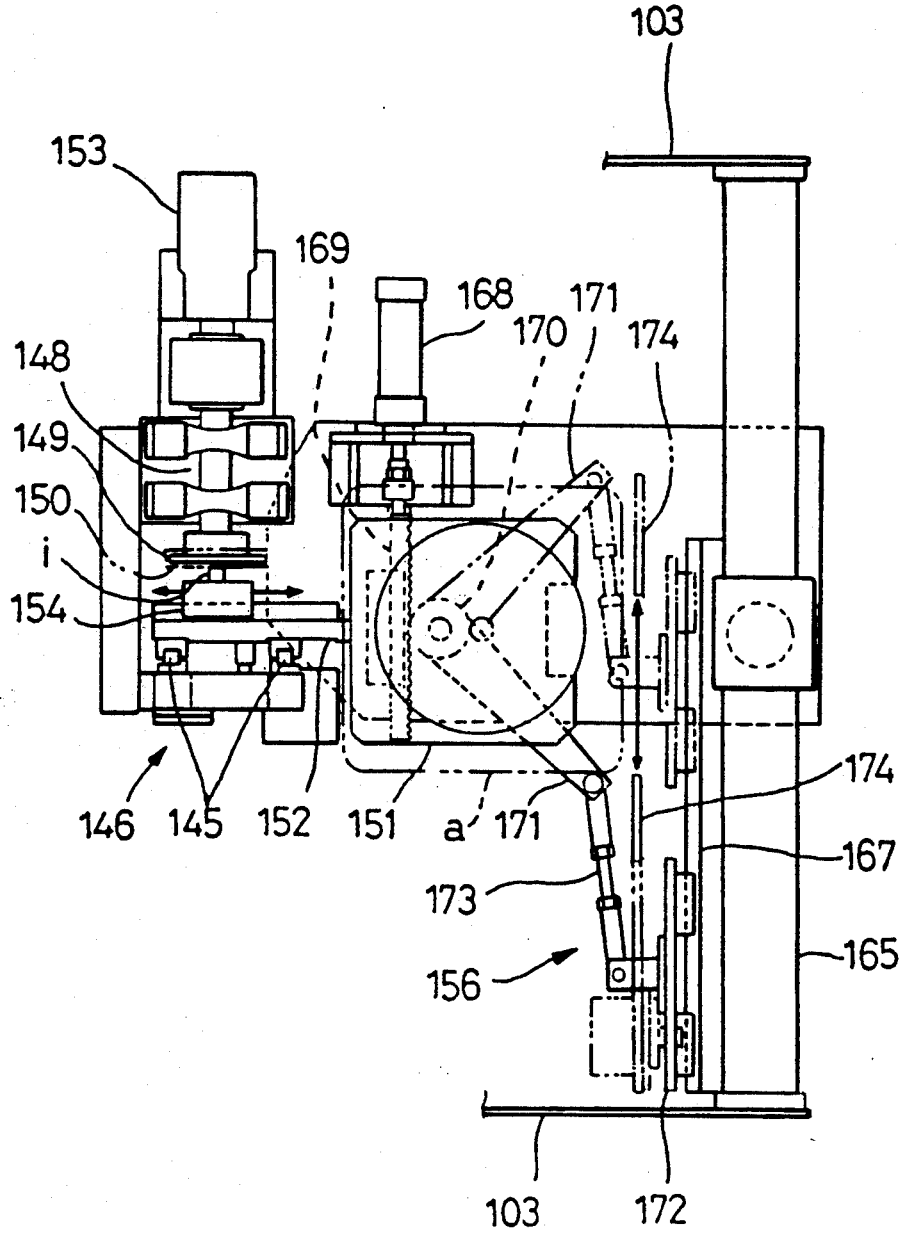
FIG. 32 is a plan view showing said sign-ascending and descending means and said posture-correcting means.

As shown in FIG. 23, the right and left longitudinal frames 103 are provided with cylindrical frames, that is upper cylindrical frames 162 and 163 and lower cylindrical frames, 164 and 165, and, as shown in FIGS. 30 to 32, said lower frame 165 is provided with said posture-correcting means 156.

The lower frame 165 is provided with a horizontal base 166 and a guide rail 167 connected therewith, said horizontal base 166 being provided with a rack 169 driven by a cylinder 168 and a pinion 170 engaged with said rack 169, and said pinion 170 being provided with an arm 171 connected therewith and a sliding member 172 is fitted slidably along said guide rail 167 and a pointed end of said sliding member 172 is connected with a pointed end of said arm 171 through a turnbuckle 173.

A posture-correcting member 174, which is engageable with a side edge of the bottom portion of a retrieved road sign (a) to correct its posture, is pivoted on the sliding member 172 so as to be rotatable around a horizontal axis, and a spring 175 and a stopper 176 for holding said posture-correcting member 174 at an appointed posture-correcting condition is provided.

In addition, said upper frame 164 on the lower portion is provided with a second stopper 177, with which the posture-correcting member 174 is engaged when the posture-correcting member 174 is changed over to a watching and waiting position (a position shown by a full line in FIG. 31), so that the free end of the posture-correcting member 174 will be swung downward at said watching and waiting position.

This is so that an engagement of a lower portion of the road sign (a) with the posture-correcting member 174 is prevented when the lower portion of the road sign (a) held by means of the sign-holding means 158 is swung by a centrifugal force during the revolution of the sign-holding means 158 by said revolving means 159.

Said means 161 for changing the sign (a)-installing-retrieval position $L_2$ to the other longitudinal side $R_2$ of the travelling car body 2 has the following structure. That is to say, as shown in FIGS. 23, 24, 33, 34, vertical shafts 178, 179 are pivoted at central positions in the direction of width of the travelling car body 2 between the respective upper and lower pairs of frames 162, 163, 164, 165 on the upper portion and the lower portion and said upper and lower vertical shafts 178, 179 are provided with cylindrical arms 181, 182 rotatably provided with a support 180 of a sign-holding means-ascending and descending mechanism 160 which will be described later.

The upper vertical shaft 178 is provided with a pinion 183 fixedly mounted thereon, the upper frame 162 on the upper portion side being provided with a rack 184 engaged with said pinion 183, a cylinder 185 being connected with said rack 184, and two sets of stopper means 186 selectively engageable with a stopper concave portion (j) of said upper arm 181 being provided.

Figure 35:
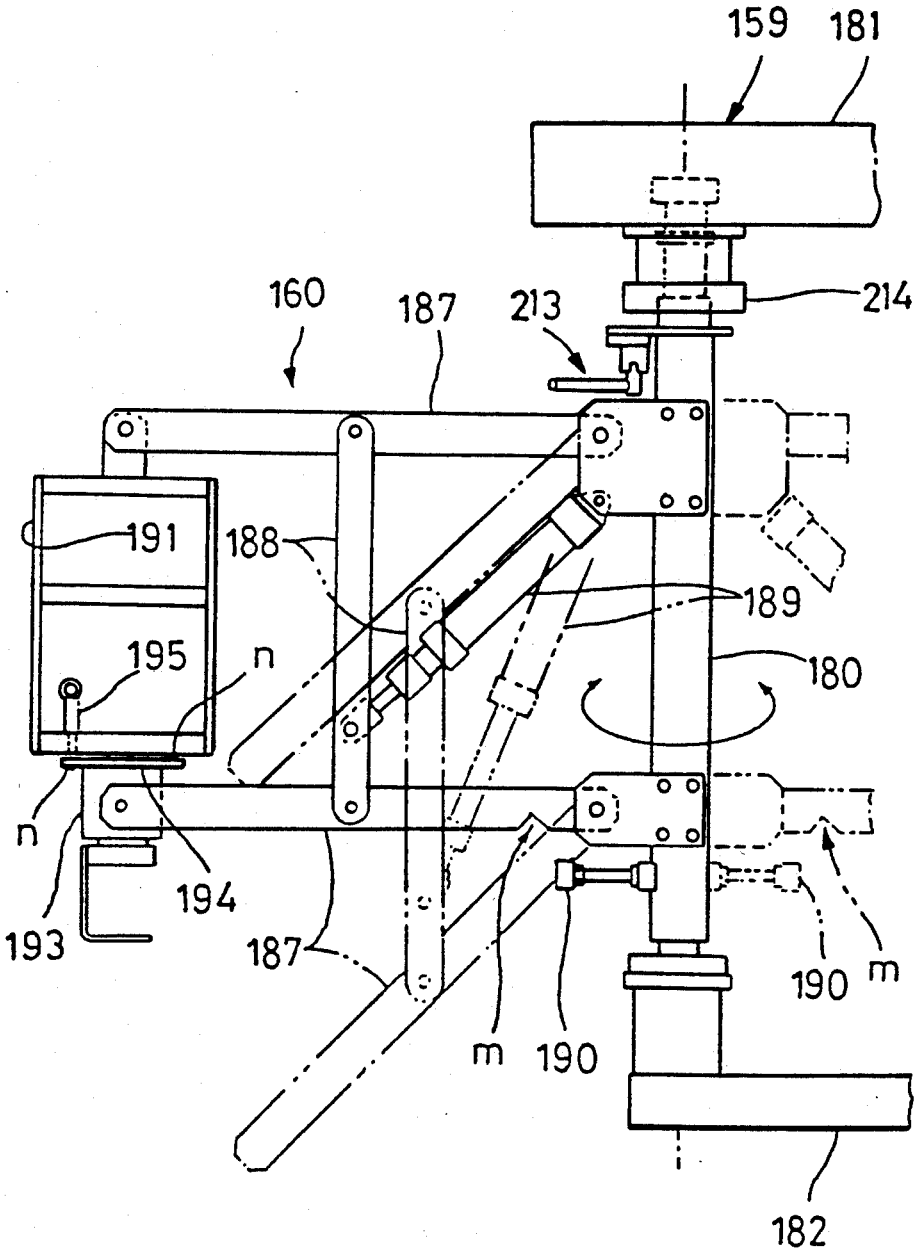
FIG. 35 is a detail drawing showing a holding means-ascending and descending mechanism.

Said sign-holding means-ascending and descending mechanism 160 has a parallel four-link structure and comprises a pair of links 187 (an upper link and a lower link) pivoted on the support 180 so as to move up and down, a longitudinal link 188 pivoted between said upper and lower links 187 and a cylinder 189 connected between said longitudinal link 188 and the support 180, as shown in FIGS. 23, 24, 35. Reference numeral 190 designates a position-regulating stopper engageable with a triangular concave portion (m) formed in the lower link 187 for regulating a descending position of the sign-holding means 158 and preventing the sign-holding means 158 from being vibrated.

The sign-holding means 158 is installed at the free ends of the upper and lower links 187 in the sign-holding means-ascending and descending mechanism 160, the upper link 187 being provided with a frame member 191 connected therewith on the free end thereof so as to be rotatable around a vertical axis, said frame member 191 being provided with a supporting shaft 192 connected therewith on a lower portion thereof, a bearing 193 being mounted on said supporting member 192, and a free end of the lower link 187 being connected with said bearing 193 as indicated in FIGS. 23, 24, 35 and 36.

In addition, engaging holes (n) are formed in an upper member 194 of the bearing 193 at a differential phase of 180° and the frame member 191 is provided with a stopper member 195 selectively engageable with and disengageable from said engaging holes (n) so that the frame member 191 including the supporting shaft 192 can be revolved by 180°.

Figure 37:
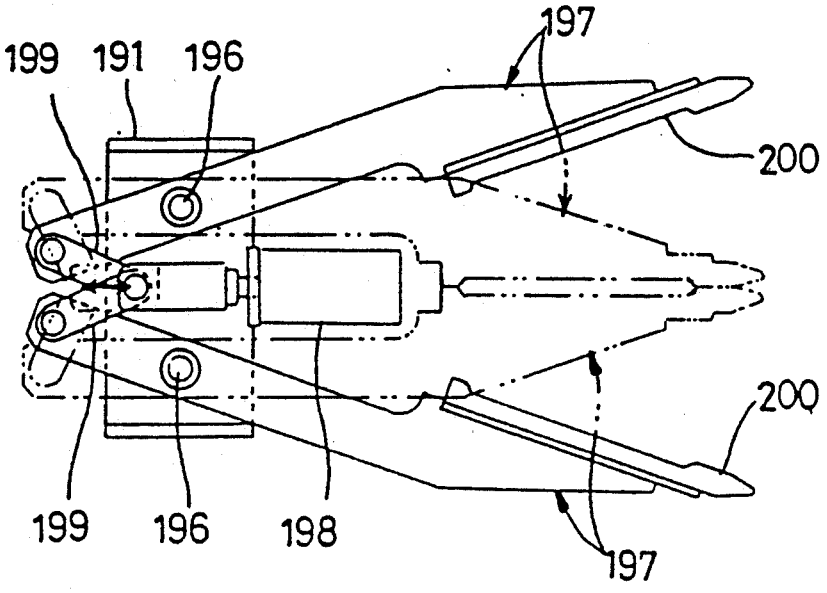
FIG. 37 is a plan view showing a sign-holding grip.

As shown also in FIG. 37, two sign-holding grips 197 provided with an elastic member 200 are pivoted on an upper portion of the frame member 191 rotatably around a vertical shaft 196 and a link 199 with a cylinder 198 connected thereto is connected with a base portion side of said sign-holding grips 197 so that the sign-holding grips 197 can be changed over between a sign-holding condition and a holding-releasing condition.

Figure 38:
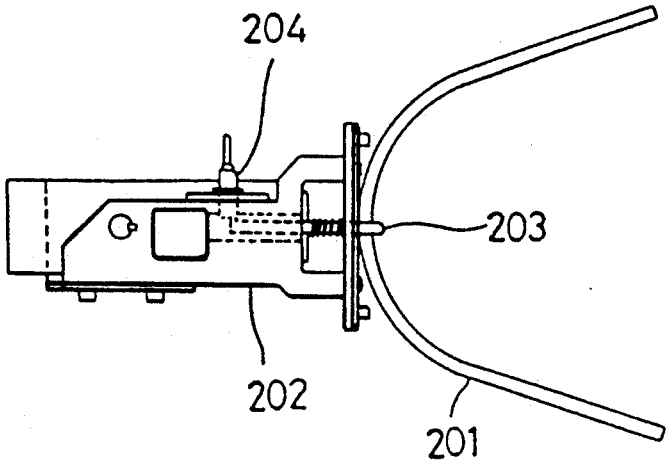
FIG. 38 is a plan view showing a holding member for holding a trunk portion of the road sign.

On the other hand, as shown also in FIG. 38, a holding member 202 holding a trunk portion-holding member 201 for the road sign (a) and movable in the back and forth direction is mounted on said lower portion of the frame member 191, said holding member 202 being provided with a slide member 203, and a sensor 204 for detecting the presence of a road sign (a) on the a basis of a movement of said slide member 203.

Figure 36:
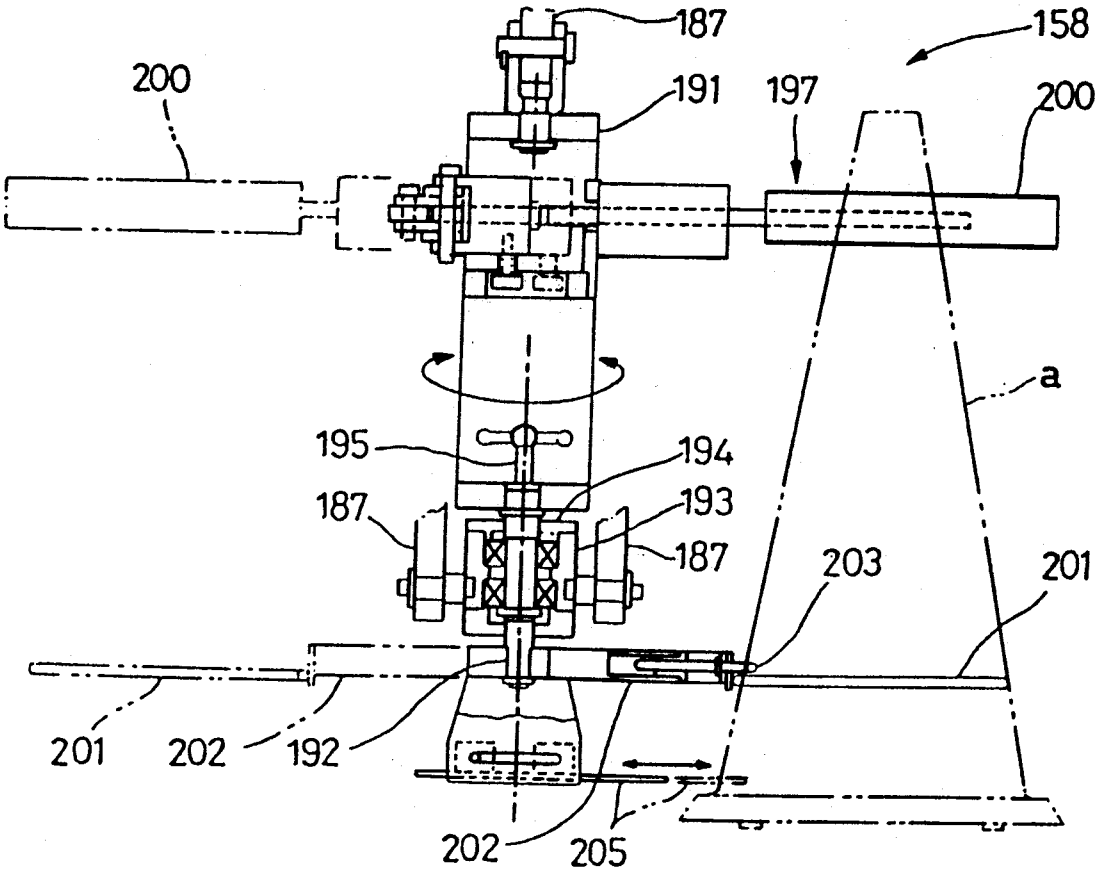
FIG. 36 is a detail drawing showing sign-holding means.

In addition, as shown in FIG. 36, a support member 205 supporting one side of the bottom portion of a road sign (a) only when the road sign (a) is installed is provided on a lower portion of the holding member 202 so as to be shiftable in the back and forth direction and fixed.

Figure 33:
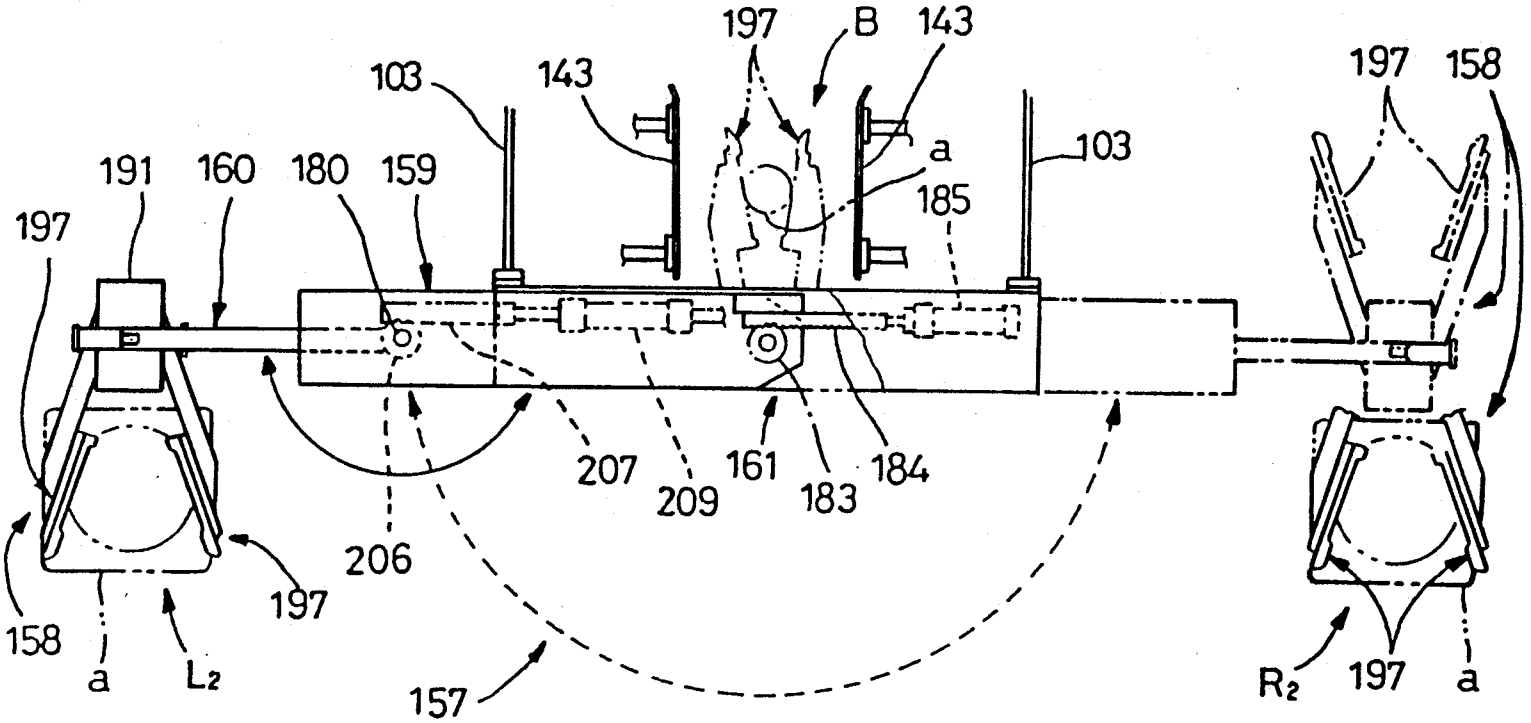
FIG. 33 is a schematic plan view showing a rear portion of the apparatus for installing and retrieving road signs.
Figure 34:
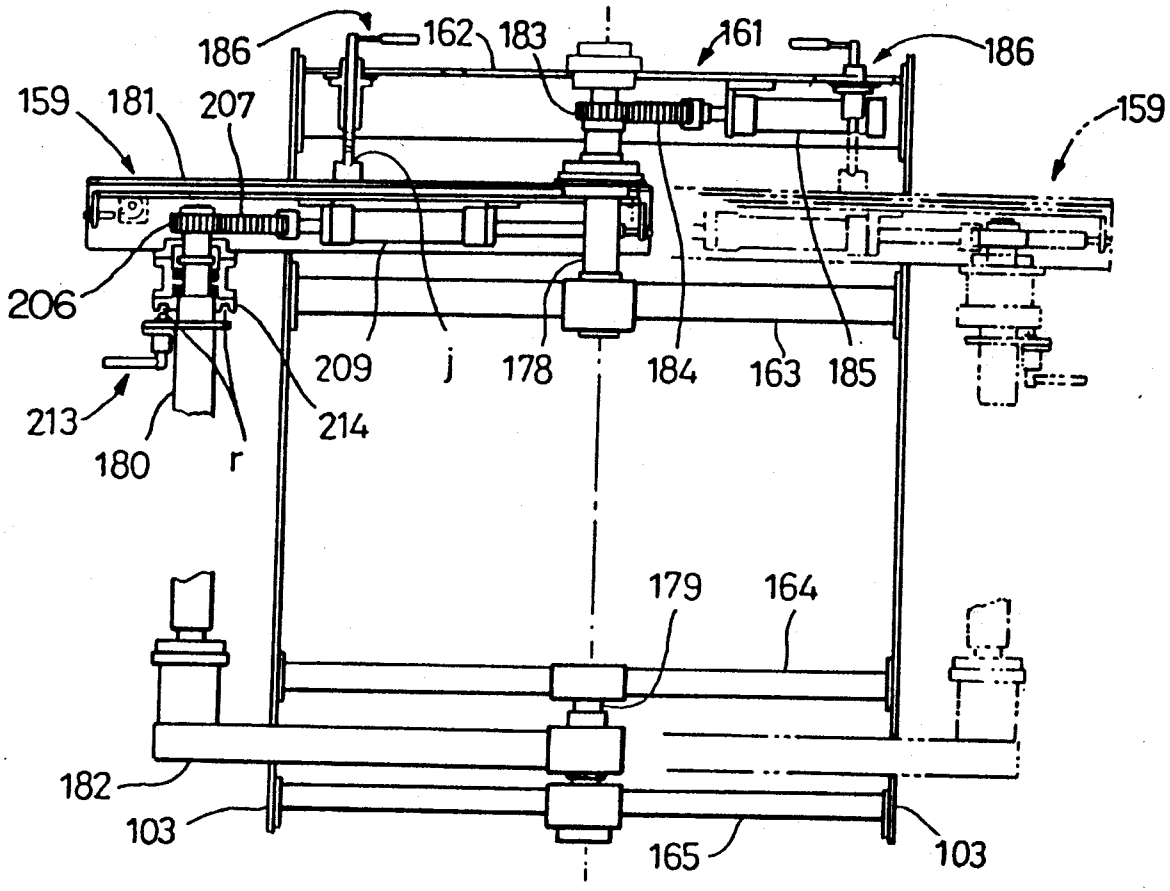
FIG. 34 is a schematic rear view showing the apparatus for installing and retrieving road signs.
Figure 39:
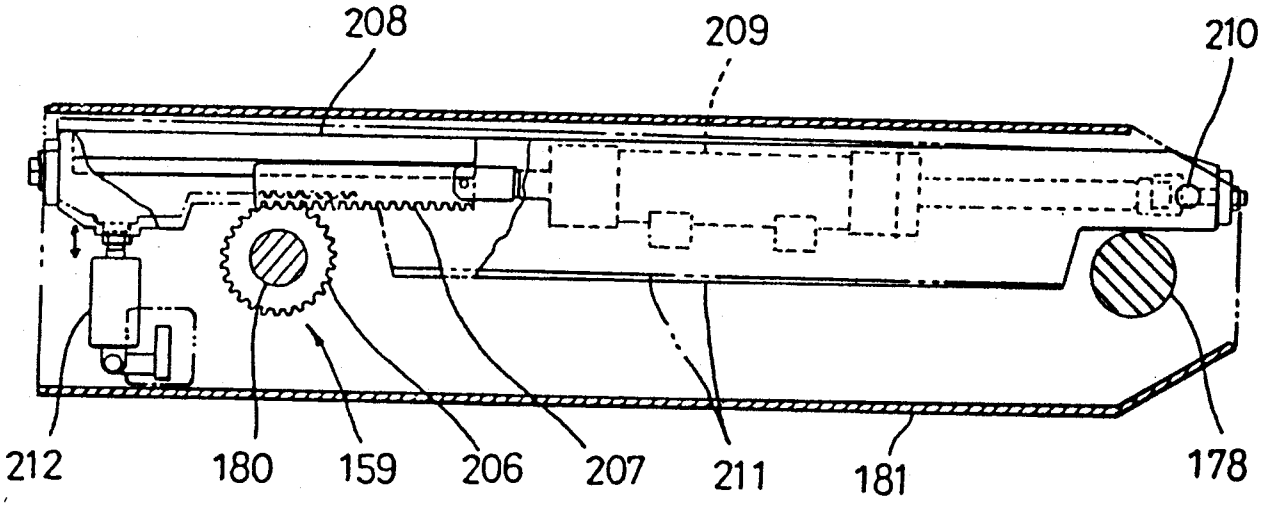
FIG. 39 is a detail drawing showing position-changing means.

Said revolving means 159 for the sign-holding means 158 has the following structure. As shown in FIGS. 33, 34, 39, the support 180 is provided with a pinion 206 fixedly mounted on an upper end thereof, a rack 207 engaging with said pinion 206 being provided so as to be movable along a guide rail 208, and a cylinder 209 being connected with said rack 207.

Said guide rail 208 and said cylinder 209 are provided on a unit base 211 swingable around a shaft 210 close to the vertical shaft 178 and said base 211 is provided with a cylinder 212 connected with a free end thereof so that an engagement of the rack 207 with the pinion 206 can be released.

In addition, referring to FIGS. 34, 35, reference numeral 213 designates stopper means which is engaged with concave portions (r) formed in a member 214 connected with the upper arm 181 at a differential phase of 180° to block revolution of the holding means-ascending and descending mechanism 160 for the upper arm 181 around the support 180.

Figure 40:
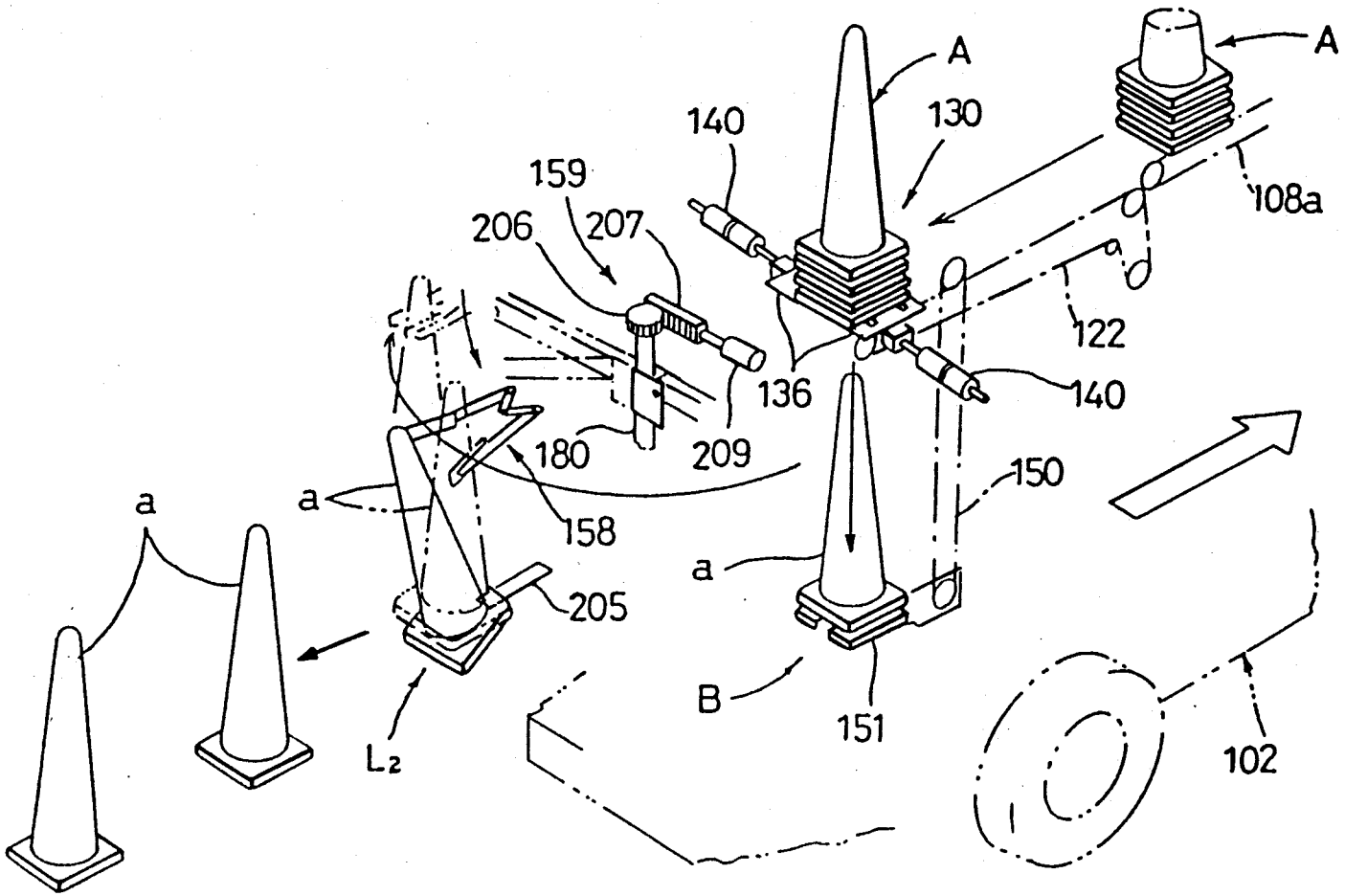
FIG. 40 is a diagram showing an operation of installing road signs.

An installation of a road sign (a) in the case where the road sign (a) is installed on one longitudinal side (left side) of the travelling car body 102 will be described. This installation of the road signs (a) is carried out by a forward travel of the travelling car body 102, as shown in FIG. 40. At first, upon regularly driving the conveying means 108 and the group of signs-conveying members 110 to convey the first group (A) of road signs on the conveying means 108 to the pair of group of signs-conveying members 110, the conveying means 108 is stopped and the group of signs-conveying members 110 are stopped at a time when the group (A) of road signs arrives at the sign-separating position (B).

Here, as shown in FIG. 28, the sign-receiving members 136 of the sign-receiving means 130 are changed over to the condition that they go between the bottom portions of the lower two road signs in the group (A) of road signs to separate a lower road sign (a) from an upper road sign (a), whereby allowing the lower road sign (a) to fall.

The fallen road sign (a) is, as shown in FIG. 30, received by the sign-supporting member 151 of the sign-ascending and descending means 146 waiting at an upper position $E_2$ and the supporting member 151 is descendedly driven so as to be stopped at a middle position $D_2$.

Subsequently, as shown in FIGS. 24, 33, the support 180 is regularly driven to change over the sign-holding means 158 from the installing retrieval position $L_2$ to the sign-separating position (B) to hold the road sign (a) by means of the sign-holding grips 197 of the sign-holding means 158. The sign-ascending and descending means 146 is descendedly driven to draw the sign-supporting member 151 out of a hollow inside of the road sign (a), stopping the sign-supporting member 151 at a lower position $C_2$.

Subsequently, the support 180 is reversely rotatably driven to change over the sign-holding means 158 to the installing-retrieving position $L_2$ of the road sign (a), the sign-holding means-ascending and descending mechanism 160 being descendedly driven midway of the rotation of the support 180, and the sign-holding grips 197 being changed over to the releasing condition at an appointed timing followed by ascendedly driving the sign-holding means-ascending and descending mechanism 160 to prepare for the installation of the next road sign, thereby completing the installation of a road sign (a).

The road sign (a) is first brought into contact with the ground on the rear side in the travelling direction of the travelling car body 102 so that it is supported by means of said bottom portion of the sign-supporting member 205 and at almost the same time the bottom portion of the sign-supporting member 205 is drawn out of the bottom portion of the sign to install the sign on the road surface, as shown in FIG. 40.

At this time, the road sign (a) has inertia force in the travelling direction, so that it is not tumbled even though it is first brought into contact with the ground on the rear side in the travelling direction of the travelling car body 102 under a single-supported condition and the inertia force acts upon the road sign (a) in the drawing direction of the bottom portion of the sign-supporting member 205, whereby the road sign (a) is installed at an appointed position without being tumbled.

During the above described sign-installing operation, the pair of group of signs-conveying members 110 approach each other to the sign-receiving posture, the sign-receiving members 136 of the sign-receiving means 130 which have been withdrawn from the bottom portion of the sign being changed over to the going condition, and the sign-ascending and descending means 146 being ascendedly driven to move the sign-supporting member 151 to said upper position $E_2$.

Subsequently, the above described operations are repeated and the conveying means 108 and the group of signs-conveying members 110 are driven midway of the installation of the final road sign (a) in a group (A) of road signs to convey a following group (A) of road signs to the sign-separating position (B). The road signs (a) can be safely and efficiently automatically installed by repeating the above described operation.

Figure 41:
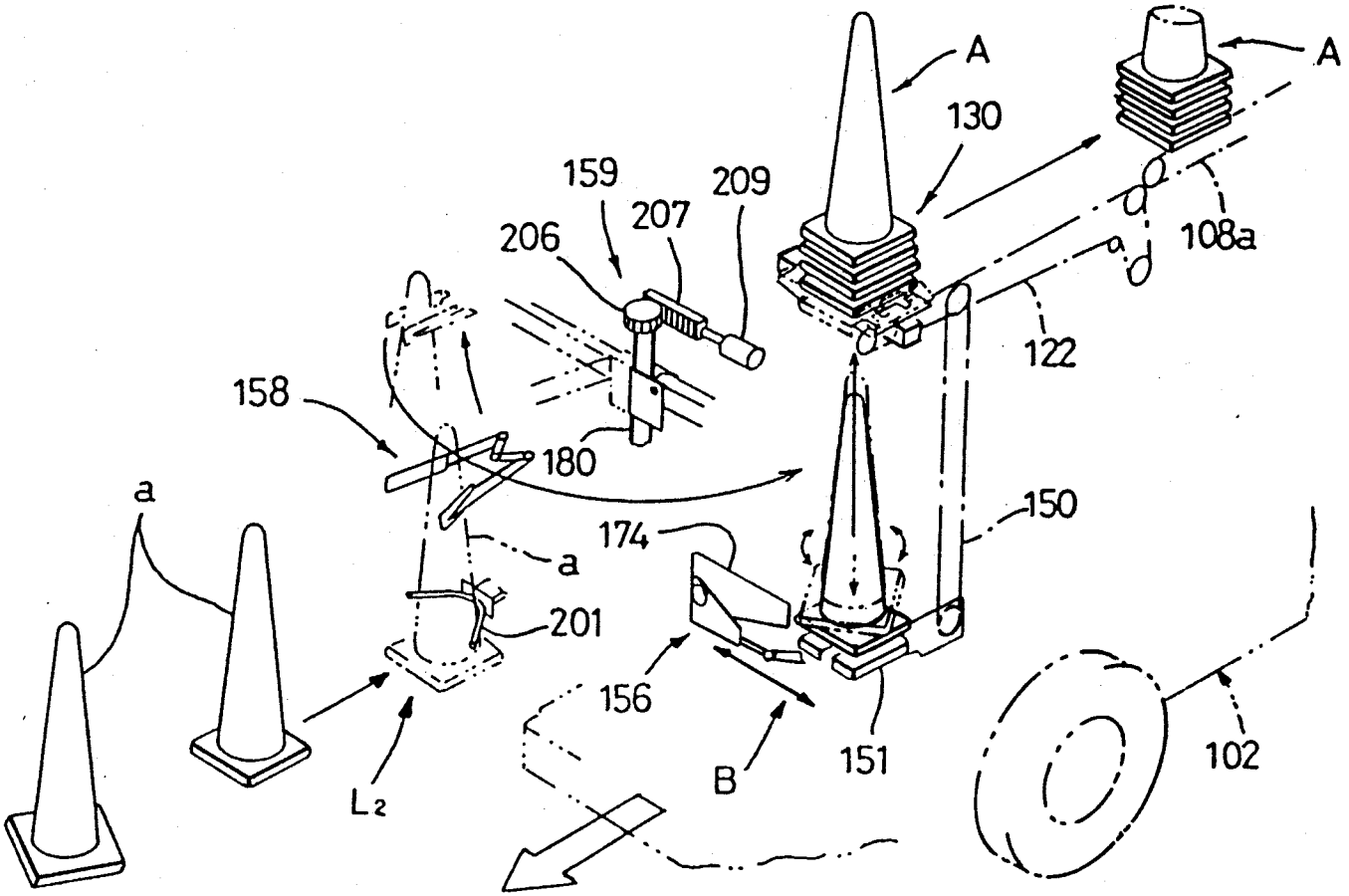
FIG. 41 is a diagram showing an operation of retrieving road signs.

The retrieval of the road signs (a) will be described. This retrieval of the road signs (a) is carried out by the rearward travelling of the travelling car body 102 in the following manner, as shown in FIG. 41. At first, the support 180 is reversely driven to change over the sign-holding means 158 from the sign-separating position (B) to the installing-retrieval position $L_2$. As soon as the sensor 204 acts upon engagement of the slide member 203 with a road sign (a) standing on the road surface, the sign-holding grips 197 of the sign-holding means 158 are changed over to the holding condition to hold the road sign (a) by means of the sign-holding grips 197.

Then, the sign-holding means-ascending and descending mechanism 160 is ascendedly driven, the support 180 being regularly driven to change the sign-holding means 158 to the sign-separating position (B), the sign-supporting member 151 of the sign-ascending and descending means 146 being lifted up to said middle position $D_2$from said lower position $C_2$, and the sign-holding grips 197 of the sign-holding means 158 being changed over to the releasing condition to place the withdrawn road sign (a) on the sign-supporting member 151.

Here, the posture-correcting means 156 is reciprocatingly driven to correct the posture of the road sign (a) if necessary and the sign-receiving member 136 of the sign-ascending and descending means 146 is lifted up to an upper position $H_2$ (a position above an operating surface of the group of signs-conveying members 110), whereby the sign-receiving members 136 are pushed up to pass the road sign (a) and the posture-correcting means 156 is returned to the original waiting position.

After the sign has passed the sign-supporting member 151 the sign-ascending and descending means 146 is changed over to the lower position $C_2$ at an appointed time. Under such condition, the sign-receiving member 136 of the sign-receiving means 130 is changed over to a horizontal posture, so that the road sign (a) is supported by means of the sign-receiving member 136.

On the other hand, at the same time as the above described return of the posture-correcting means 156, the support 180 is reversely driven to change over the sign-holding means 158 to the installing-retrieving position $L_2$ and the sign-holding means-ascending and descending mechanism 160 is lowered, whereby the sign-holding means 158 is prepared for the retrieval of the following road sign (a).

Thereafter, the above described operations are repeated to retrieve the final road sign (a) to be retrieved. Thereupon, the pair of group of signs-conveying members 110 approach to each other so as to assume the sign-receiving posture and the sign-receiving members 136 of the sign-receiving means 130 are changed over to the releasing condition so that the group (A) of a plurality of retrieved road signs (a) is supported by means of the group of signs-conveying members 110, and the group of signs-conveying members 110 and the conveying means 108 are reversely driven to take the group (A) of retrieved road signs on the conveying means 108. The road signs (a) can be safely and efficiently automatically retrieved by repeating this operation.

The procedures for changing the installing-retrieving position $L_2$ of the road signs (a) to the other longitudinal side $R_2$ (right side) of the travelling car body 102 will be described.

Normally the stopper means 213 shown in FIG. 34 is engaged with the concave portion (r) formed in the member 214 connected with the upper arm 181 to block revolution of the holding means-ascending and descending mechanism 160 relative to the upper arm 181.

Then, as shown in FIG. 39, the cylinder 212 is extended to release engagement of the pinion 206 and the rack 207 and after extending the cylinder 209 of the revolving means 159 the cylinder 212 is contracted to engage the rack 207 with the pinion 206.

Thus, the revolving phase of the holding means-ascending and descending mechanism 160 by the revolving means 159 is changed by 180°.

Then the fixation of the holding means-ascending and descending mechanism 160 by the stopper means 213 and a fixation of the upper arm 181 on the upper frame 162 by the stopper means 186 is released, respectively, and the cylinder 185 is extended to rotate the whole holding means-ascending and descending mechanism 160 including the sign-holding means 158 around the vertical shafts 178, 179 by 180°, as shown in FIGS. 23, 33, 34.

Under such condition, as shown by phantom lines in FIG. 33, the sign-holding grips 197 of the sign-holding means 158 face forward in the travelling direction of the travelling car body 102. Then the fixation of the sign-holding means 158 on the holding means-ascending and descending mechanism 160 by the stopper member 195 shown in FIG. 35, 36 is released and the sign-holding means 158 is manually rotated by 180°, thereby permitting the installation and retrieval of the road signs (a) on the right side of the travelling car body 102.

In addition, although the road sign (a) is supported by means of the bottom portion of the sign-supporting member 205 in the installation of the road signs (a), the bottom portion of the sign-supporting member 205 may be omitted and the road sign (a) can be allowed to fall on the road surface in an upright posture.

Figure 42A:
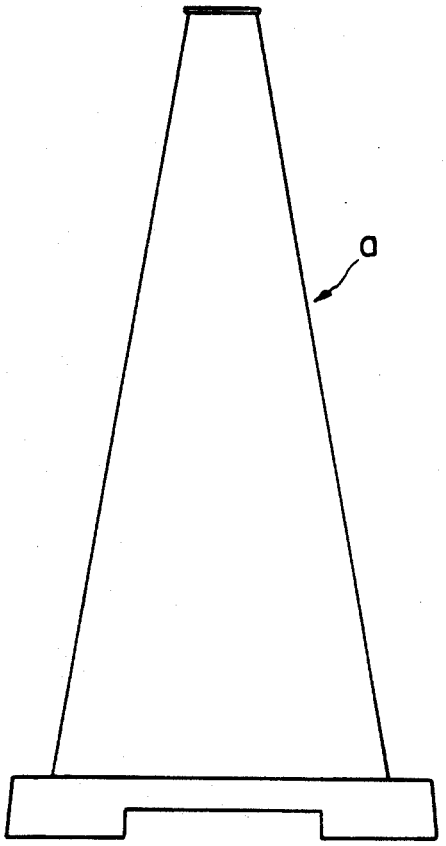
FIG. 42A is a drawing showing another preferred embodiment of a road sign.
Figure 42B:
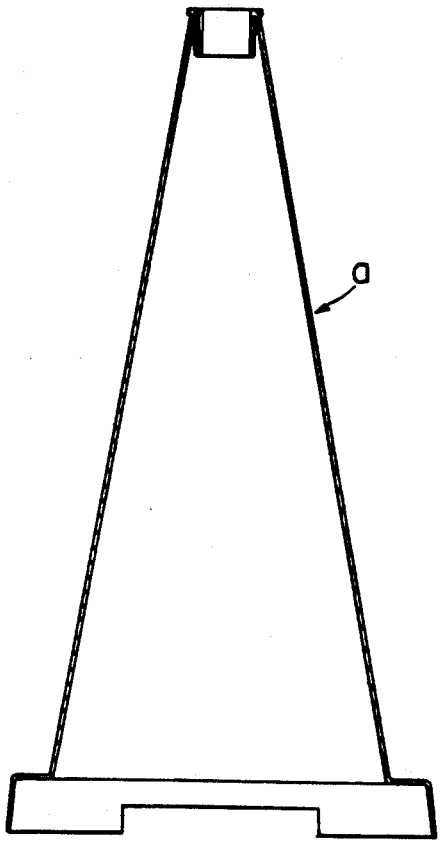
FIG. 42B is a cross-section of FIG. 42A.

Furthermore, road signs (a) having various kinds of shape may be used. One example is shown in FIG. 42.

As above described, by the apparatus for installing and retrieving road signs according to the first and second inventions, not only can the road signs be installed in good order at the appointed positions without being tumbled and the automatically installed road signs can be automatically retrieved, but also the improvement of safety, the labor-saving and the remarkable improvement of working efficiency as compared with the conventional apparatus can be achieved.

In addition, according to the second invention, additionally the road signs can be installed and retrieved from either the right or left side of the travelling vehicle body by changing the position of the sign-holding means from one longitudinal side to the other longitudinal side of the vehicle body.

What is claimed is:

1. An apparatus for installing and retrieving road signs, comprising means for conveying a group of a plurality of hollow road signs stacked upon one another, a pair of group of signs-conveying members for conveying said group of road signs while supporting both sides of a bottom portion of the group of the road signs, condition-changing over means for causing said pair of group of road signs-conveying member to approach and separate from each other to change between a sign-supporting condition and a supporting-releasing condition, a pair of sign-receiving means arranged at sign-separating positions at ends of the group of signs-conveying members, moving means for causing said pair of sign-receiving means to approach and separate from each other in a direction the same as a moving direction of the group of signs-conveying members, sign-ascending and descending means disposed within a hollow inside of the road sign for supporting and causing the ascending and descending of the road sign, posture-correcting means for correcting a posture of the road sign supported by said sign-ascending and descending means, sign-holding means for releasably holding the road sign, revolving means for revolving said sign-holding means ranging from a position, where the sign is separated, midway of a width of a vehicle body to a position, where the sign is installed and retrieved, on one longitudinal side of the vehicle body and a holding means-ascending of the sign-holding means at said position where the sign is installed and retrieved, carried on a loading platform of a travelling vehicle body, respectively.

2. An apparatus for installing and retrieving road signs, comprising means for conveying a group of a plurality of hollow road signs stacked upon one another, a pair of group of signs-conveying members for conveying said group of road signs while supporting both sides of a bottom portion of the group of the road signs, condition-changing over means for causing said pair of group of road signs-conveying member to approach and separate from each other to change between a sign-supporting condition and a supporting-releasing condition, a pair of sign-receiving means arranged at sign-separating positions at ends of the group of signs-conveying members, moving means for causing said pair of sign-receiving means to approach and separate from each other in a direction the same as a moving direction of the group of signs-conveying members, sign-ascending and descending means disposed within a hollow inside of the road sign for supporting and causing the ascending and descending of the road sign, posture-correcting means for correcting a posture of the road sign supported by said sign-ascending and descending means, sign-holding means for releasably holding the road sign, revolving means for revolving said sign-holding means ranging from a position, where the sign is separated, midway of a width of a vehicle body to a position, where the sign is installed and retrieved, on one longitudinal side of the vehicle body, a holding means-ascending and descending mechanism for causing ascending and descending of the sign-holding means at said position where the sign is installed and retrieved, and position-changing means for changing the position, where the sign is installed and retrieved by means of the sign-holding means, onto another longitudinal side of the vehicle body, carried on a travelling vehicle body, respectively.

* * * * *